US010865348B2

(12) United States Patent
Narayanaswamy et al.

(10) Patent No.: US 10,865,348 B2
(45) Date of Patent: Dec. 15, 2020

(54) PROCESS WHICH DOES SIMULTANEOUS DEHYDROCHLORINATION AND HYDROCRACKING OF PYROLYSIS OILS FROM MIXED PLASTIC PYROLYSIS WHILE ACHIEVING SELECTIVE HYDRODEALKYLATION OF C9+ AROMATICS

(71) Applicant: SABIC Global Technologies B.V., Bergen op Zoom (NL)

(72) Inventors: Ravichander Narayanaswamy, Bangalore (IN); Krishna Kumar Ramamurthy, Bangalore (IN)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/316,260

(22) PCT Filed: Jun. 8, 2017

(86) PCT No.: PCT/IB2017/053407
§ 371 (c)(1),
(2) Date: Jan. 8, 2019

(87) PCT Pub. No.: WO2018/011642
PCT Pub. Date: Jan. 18, 2018

(65) Prior Publication Data

US 2019/0233744 A1 Aug. 1, 2019

Related U.S. Application Data

(60) Provisional application No. 62/361,639, filed on Jul. 13, 2016.

(51) Int. Cl.
*C10G 47/02* (2006.01)
*C10G 47/06* (2006.01)
(Continued)

(52) U.S. Cl.
CPC ..... *C10G 47/02* (2013.01); *C10G 1/002* (2013.01); *C10G 1/10* (2013.01); *C10G 45/08* (2013.01);
(Continued)

(58) Field of Classification Search
None
See application file for complete search history.

(56) References Cited

U.S. PATENT DOCUMENTS 3,174,925 A * 3/1965 Claussen ..... C10G 65/10 208/59
3,316,169 A * 4/1967 Peck ..... C10G 47/00 208/111.25
(Continued)

FOREIGN PATENT DOCUMENTS

CN 1400288 A 3/2003
EP 0726306 A1 8/1996
(Continued)

OTHER PUBLICATIONS

ECHA "Gas oils (petroleum), straight-run" Updated Mar. 16, 2020. (Year: 2020).*
(Continued)

*Primary Examiner* — Philip Y Louie
*Assistant Examiner* — Alyssa L Cepluch
(74) *Attorney, Agent, or Firm* — Norton Rose Fulbright US LLP

(57) ABSTRACT

A process for hydrodealkylating a hydrocarbon stream comprising (a) contacting the hydrocarbon stream with a hydroprocessing catalyst in a hydroprocessing reactor in the presence of hydrogen to yield a hydrocarbon product, wherein the hydrocarbon stream contains $C_9$+ aromatic hydrocarbons; and (b) recovering a treated hydrocarbon stream from the hydrocarbon product, wherein the treated
(Continued)

hydrocarbon stream comprises $C_9$+ aromatic hydrocarbons, wherein an amount of $C_9$+ aromatic hydrocarbons in the treated hydrocarbon stream is less than an amount of $C_9$+ aromatic hydrocarbons in the hydrocarbon stream due to hydrodealkylating of at least a portion of $C_9$+ aromatic hydrocarbons from the hydrocarbon stream during the step (a) of contacting.

16 Claims, 1 Drawing Sheet

(51) Int. Cl.

| | |
|---|---|
| ***C10G 47/12*** | (2006.01) |
| ***C10G 47/00*** | (2006.01) |
| ***C10G 47/14*** | (2006.01) |
| ***C10G 47/04*** | (2006.01) |
| ***C10G 1/00*** | (2006.01) |
| ***C10G 1/10*** | (2006.01) |
| ***C10G 45/08*** | (2006.01) |
| ***C10G 67/02*** | (2006.01) |
| ***C10G 69/06*** | (2006.01) |

(52) U.S. Cl.
CPC ..... *C10G 47/00* (2013.01); *C10G 47/04* (2013.01); *C10G 47/06* (2013.01); *C10G 47/12* (2013.01); *C10G 47/14* (2013.01); *C10G 67/02* (2013.01); *C10G 69/06* (2013.01); *C10G 2300/1003* (2013.01); *C10G 2300/1096* (2013.01); *C10G 2300/202* (2013.01); *C10G 2300/703* (2013.01)

(56) References Cited

U.S. PATENT DOCUMENTS

| | | | | |
|---|---|---|---|---|
| 5,107,051 | A * | 4/1992 | Pannell | B01J 23/85 208/14 |
| 5,849,964 | A * | 12/1998 | Holighaus | C10G 1/10 585/241 |
| 8,895,790 | B2 | 11/2014 | Narayanaswamy et al. | 585/241 |
| 9,200,207 | B2 | 12/2015 | Huang et al. | 585/242 |
| 2009/0272672 | A1 | 11/2009 | Arca et al. | 208/120.3 |
| 2010/0076236 | A1* | 3/2010 | Van Heuzen | C10L 1/08 585/313 |
| 2011/0083997 | A1* | 4/2011 | Silva | C10G 49/00 208/60 |
| 2012/0149958 | A1 | 6/2012 | Ellrich et al. | 585/321 |
| 2014/0228606 | A1* | 8/2014 | Narayanaswamy | C10G 1/10 585/241 |
| 2015/0080624 | A1 | 3/2015 | Gephart et al. | 585/241 |
| 2015/0141724 | A1 | 5/2015 | Frey et al. | 585/319 |
| 2016/0264874 | A1 | 9/2016 | Narayanaswamy et al. | |
| 2016/0264880 | A1 | 9/2016 | Narayanaswamy et al. | |
| 2016/0264883 | A1 | 9/2016 | Narayanaswamy et al. | |
| 2016/0264884 | A1 | 9/2016 | Narayanaswamy et al. | |
| 2016/0264885 | A1 | 9/2016 | Narayanaswamy et al. | |
| 2019/0161683 | A1* | 5/2019 | Narayanaswamy | C10B 53/07 |

FOREIGN PATENT DOCUMENTS

| | | | | |
|---|---|---|---|---|
| JP | 2007308655 | A | 11/2007 | |
| JP | 2009242555 | A | 10/2009 | |
| JP | 04520095 | B2 | 8/2010 | |
| JP | 04943816 | B2 | 5/2012 | |
| WO | WO2001018152 | A1 | 3/2001 | |
| WO | WO2007126121 | A1 | 11/2007 | |
| WO | WO-2013112969 | A2 * | 8/2013 | C10G 9/36 |
| WO | WO2015128033 | A1 | 9/2015 | |

OTHER PUBLICATIONS

ECHA "Gasoline, Pyrolysis" Updated Dec. 21, 2019 (Year: 2019).*
ECHA Gas oils (petroleum), straight-run—Registration Dossier. First Published 2011. pp. 1-50 (Year: 2011).*
Cho et al. "Pyrolysis of Mixed Plastic Wastes for the Recovery of Benzene, Toluene, and Xylene (BTX) Aromatics in a Fluidized Bed and Chlorine Removal by Applying Various Additives." *Energy Fuels,* 2010, 24 (2), 1389-1395.
Shah et al. "Conversion of Waste Plastic to Oil: Direct Liquefaction versus Pyrolysis and Hydroprocessing." *Energy Fuels,* 1999, 13 (4), 832-838.
Shiraga et al. "Boiling-Point Distributions and Dechlorination of Organic Chlorine Compounds in Oil Obtained from the Degradation of PVC Mixed Plastic." *Energy Fuels,* 1999, 13 (2), 428-432.
U.S. Appl. No. 62/201,655, filed Aug. 6, 2015.
U.S. Appl. No. 62/201,657, filed Aug. 6, 2015.
U.S. Appl. No. 60/2201,664, filed Aug. 6, 2015.
U.S. Appl. No. 62/201,669, filed Aug. 6, 2015.
U.S. Appl. No. 62/201,676, filed Aug. 6, 2015.
Indian Patent Application IN1163/CHE/2015 filed Mar. 10, 2015.
Indian Patent Application IN1164/CHE/2015 filed Mar. 10, 2015.
Indian Patent Application IN1166/CHE/2015 filed Mar. 10, 2015.
Indian Patent Application IN1170/CHE/2015 filed Mar. 10, 2015.
Indian Patent Application IN1171/CHE/2015 filed Mar. 10, 2015.
International Search Report and Written Opinion for PCT/IB2017/053407, dated Oct. 2, 2017, 9 pages.

* cited by examiner

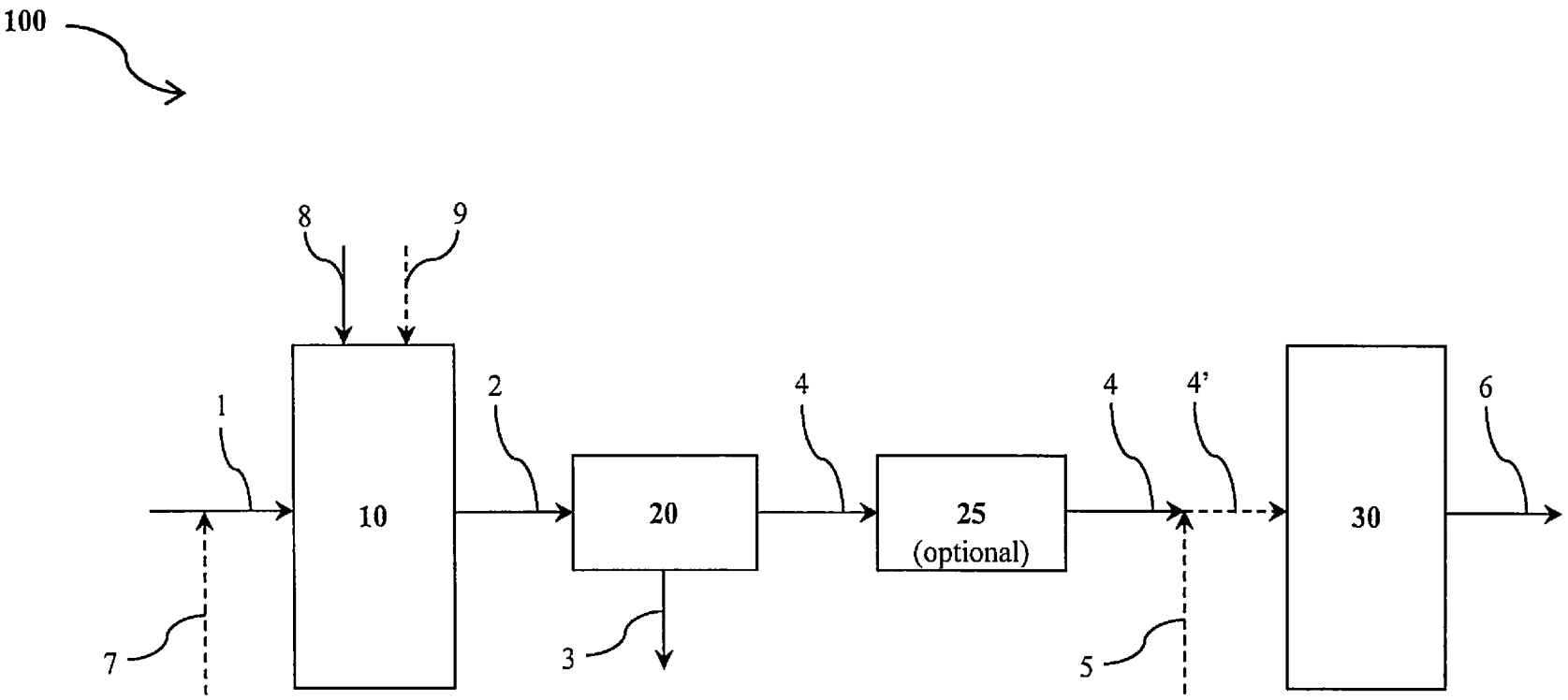
100
1
7
8
9
10
2
20
3
4
25
(optional)
4
4'
5
30
6

PROCESS WHICH DOES SIMULTANEOUS DEHYDROCHLORINATION AND HYDROCRACKING OF PYROLYSIS OILS FROM MIXED PLASTIC PYROLYSIS WHILE ACHIEVING SELECTIVE HYDRODEALKYLATION OF C9+ AROMATICS

This application is a national phase application under 35 U.S.C. § 371 of International Application No. PCT/IB2017/053407 filed Jun. 8, 2017, which claims priority to U.S. Provisional Patent Application No. 62/361,639 filed Jul. 13, 2016. The entire contents of each of the above-referenced disclosures is specifically incorporated by reference herein without disclaimer.

TECHNICAL FIELD

This disclosure relates to the treatment of hydrocarbon streams via processes which include simultaneous dechlorination, cracking and dealkylation.

BACKGROUND

Waste plastics may contain polyvinylchloride (PVC) and/or polyvinylidene chloride (PVDC). Through a pyrolysis process, waste plastics can be converted to gas and liquid products. These liquid products (e.g., pyrolysis oil) may contain paraffins, iso-paraffins, olefins, naphthenes, and aromatic components along with organic chlorides in concentrations of hundreds of ppm. Typically, the boiling end point of pyrolysis oil can be much higher than that of a typical diesel fraction boiling end point. In order to feed the pyrolysis oil to a steam cracker, it is necessary to dechlorinate the pyrolysis oil feed to reach very low concentrations of chlorine, saturate olefins in the feed, and have a boiling end point low enough to avoid possible fouling and corrosion in the process. Additionally, it would be preferable if $C_9$+ aromatic hydrocarbons in a feedstock for steam crackers were converted to $C_{6-8}$ aromatic hydrocarbons (e.g., benzene, toluene, xylenes, ethylbenzene, etc.) and/or saturated feedstock, while preserving mono-ring aromatics in the feedstock. Thus, there is an ongoing need to develop treatment methods for hydrocarbon feedstocks derived from waste plastics to meet certain steam cracker feed requirements.

BRIEF DESCRIPTION OF THE DRAWINGS

The FIGURE illustrates a hydroprocessing system which simultaneously hydrodealkylates $C_9$+ aromatic hydrocarbons and dechlorinates chloride compounds using a sulphided hydroproces sing catalyst, while additionally hydrocracks heavy hydrocarbon molecules and hydrogenates olefins contained in a hydrocarbon stream to levels suitable for introduction to a steam cracker.

DETAILED DESCRIPTION

Disclosed herein are processes and systems for hydroprocessing of a hydrocarbon stream, which include contacting the hydrocarbon stream containing $C_9$+ aromatic hydrocarbons with a hydroprocessing catalyst in the presence of hydrogen to yield a hydrocarbon product. The processes may include producing a treated hydrocarbon stream from the hydrocarbon product, where the treated hydrocarbon stream has a reduced amount of chloride compounds and a reduced amount of $C_9$+ aromatic hydrocarbons when compared to the amount of chloride compounds and the amount of $C_9$+ aromatic hydrocarbons, respectively in the hydrocarbon stream. For purposes of the disclosure herein, the term "amount" refers to a weight % of a given component in a particular composition, based upon the total weight of that particular composition (e.g., the total weight of all components present in that particular composition), unless otherwise indicated. The hydrocarbon stream undergoes simultaneous dechlorination, dealkylation and cracking.

Processes for hydroprocessing of a hydrocarbon stream are described in more detail with reference to FIG. 1. FIG. 1 illustrates a hydroprocessing system 100 which hydrodealkylates $C_9$+ aromatic hydrocarbons using a hydroprocessing catalyst (e.g., sulphided hydroprocessing catalyst), and additionally hydrocracks heavy hydrocarbon molecules, dechlorinates chloride compounds and hydrogenates olefins contained in a hydrocarbon stream 1 to levels suitable for introduction to a steam cracker 30. The system 100 includes a hydroprocessing reactor 10, a separator 20, an optional polishing unit 25, and a steam cracker 30. The hydrocarbon stream 1 feeds to the hydroprocessing reactor 10, and the reaction product effluent flows from the hydroprocessing reactor 10 in the hydrocarbon product stream 2 to the separator 20. In separator 20, a treated product is recovered from the hydrocarbon product stream 2 and flows from the separator 20 via treated hydrocarbon stream 4, with one or more sulphur-containing gases and/or chlorine-containing gases flowing from the separator 20 in stream 3. It is contemplated in some configurations of the hydroprocessing system that a second hydroprocessing reactor and a second separator may be placed in between separator 20 and treated hydrocarbon stream 4. The treated product flowing from the separator 20, in such configurations, may contain residual sulphur (S), and the second hydroprocessing reactor/second separator combination (e.g., optional polishing unit 25) may treat the treated product flowing from the separator 20 to completely remove the sulphur (e.g., polish the effluent from reactor 10 and separator 20) such that a second treated product flowing in the treated hydrocarbon stream 4 from the second separator contains less than 200, 100, 90, 80, 70, 60, 50, 40, 30, 20, 10, 9, 8, 7, 6, 5, 4, 3, 2, 1, 0.5, 0.1 ppmw S, based on the total weight of the treated hydrocarbon stream 4. As will be appreciated by one of skill in the art and with the help of this disclosure, the content/composition of treated hydrocarbon stream 4 is dependent upon whether the optional polishing unit 25 is used or not for polishing the treated hydrocarbon stream 4. The composition of stream 4 is described in more detail later herein.

The treated product in the treated hydrocarbon stream 4 may flow directly (e.g., without any separations or fractionations of the treated hydrocarbon stream 4) or via blended hydrocarbon stream 4' (e.g., without any separations or fractionations of the treated hydrocarbon stream 4 and blended hydrocarbon stream 4') to a steam cracker 30, from which high value products flow in stream 6. The treated hydrocarbon stream 4 may be blended with a non-chlorinated hydrocarbon stream 5 to yield the blended hydrocarbon stream 4'.

The hydrocarbon stream 1 generally includes one or more hydrocarbons, at least a portion of which are $C_9$+ aromatic hydrocarbons. The hydrocarbon stream 1 may additionally include one or more sulphides, one or more chloride compounds, hydrogen, or combinations thereof. The hydrocarbon stream 1 is generally in a liquid phase. A $H_2$ stream can be added to hydrocarbon stream 1 before entering the hydroprocessing reactor 10. Optionally, a $H_2$ stream is additionally added in between various catalyst beds in a multi-bed arrangement in the hydroprocessing reactor 10 to enrich the reactor environment with $H_2$.

The hydrocarbon stream 1 may be a stream from an upstream process, such as a pyrolysis process (e.g., plastic pyrolysis oil), which contains one or more chloride compounds, and optionally, also one or more sulphides, for example, from the pyrolysis of waste plastics. When the stream from the upstream process does not contain one or more sulphides in the amounts disclosed herein, the hydrocarbon stream 1 may be doped with one or more sulphides, for example via a doping stream 7.

The hydrocarbon stream 1 can be a plastic pyrolysis oil. The hydrocarbon stream 1 may be one or more pyrolysis oils which contain any of paraffins, i-paraffins, olefins, naphthenes, aromatic hydrocarbons, chloride compounds, sulphides, or combinations thereof as disclosed herein. One or more pyrolysis oils may be obtained from pyrolysis of waste plastics (for example, from a high severity process as disclosed in U.S. Pat. No. 8,895,790, which is incorporated by reference in its entirety, or from any low temperature severity pyrolysis process known in the art and with the aid of this disclosure). It is contemplated that in some aspects, at least a portion of the plastic pyrolysis oils comprises heavy hydrocarbon molecules (e.g., also referred to as heavy ends of the pyrolysis oils), as well as $C_9$+ aromatic hydrocarbons. Hydrocracking of the heavy ends of the plastic pyrolysis oils to meet steam cracker 30 feed requirements is contemplated, in addition to hydrodealkylating at least a portion of the $C_9$+ aromatic hydrocarbons to provide for $C_{6-8}$ aromatic hydrocarbons. For purposes of the disclosure herein, the term "heavy hydrocarbon molecules" exclude $C_9$+ aromatic hydrocarbons.

The plastic waste may contain polyolefins, polystyrenes, polyethylene terephthalate (PET), polyvinylchloride (PVC), polyvinylidene chloride (PVDC), and the like, or combinations thereof. In an aspect, the plastic waste comprises equal to or greater than about 400 ppmw, 600 ppmw, 800 ppmw, 1,000 ppmw, or more PVC and/or PVDC, based on the total weight of the plastic waste.

The hydrocarbon stream 1 may include a reformate stream from catalytic naphtha reformer, a tire pyrolysis oil, a petroleum origin stream, a petroleum refinery stream, pyrolysis gasoline, alkyl aromatic containing streams, any other suitable chloride containing hydrocarbon stream, or combinations thereof. In some aspects, the hydrocarbon stream 1 may be one or more pyrolysis oils which is blended with a heavier oil (e.g., a naphtha or diesel oil, via doping stream 7).

Examples of one or more hydrocarbons which may be included in the hydrocarbon stream 1 include paraffins (n-paraffin, i-paraffin, or both), olefins, naphthenes, aromatic hydrocarbons, or combinations thereof. When the one or more hydrocarbons includes all the listed hydrocarbons, the group of hydrocarbons may be collectively referred to as a PONA feed (paraffin, olefin, naphthene, aromatics) or PIONA feed (n-paraffin, i-paraffin, olefin, naphthene, aromatics).

Any aromatic hydrocarbon may be included in the hydrocarbon stream 1. The hydrocarbon stream 1 may comprise $C_9$+ aromatic hydrocarbons, such as aromatic hydrocarbons with carbon numbers of 9, 10, 11, 12, 13, 14, 15, 16, 17, 18, 19, 20, 21, 22, 23, 24, 25, 26, 27, 28, 29, 30, and higher. In an aspect, the aromatic hydrocarbons carbon number can be as high as 22. Nonlimiting examples of $C_9$+ aromatic hydrocarbons suitable for use in the present disclosure as part of the hydrocarbon stream 1 include propylbenzenes, trimethylbenzenes, tetramethylbenzenes, dimethylnaphthalene, biphenyl, and the like, or combinations thereof. The $C_9$+ aromatic hydrocarbons can be present in the hydrocarbon stream 1 in an amount of from about 1 wt. % to about 99 wt. %, alternatively from about 10 wt. % to about 90 wt. %, or alternatively from about 25 wt. % to about 75 wt. %, based on the total weight of the hydrocarbon stream 1. Greater than 5 wt. %, 10 wt. %, 15 wt. %, 20 wt. %, 25 wt. %, 30 wt. %, or more of the $C_9$+ aromatic hydrocarbons in the hydrocarbon stream 1 are hydrodealkylated when the hydrocarbon stream 1 is contacted with the hydroprocessing catalyst in the hydroprocessing reactor 10.

The hydrocarbon stream 1 can further comprise $C_{6-8}$ aromatic hydrocarbons, such as benzene, toluene, xylenes, ethyl benzene, or combinations thereof. The $C_{6-8}$ aromatic hydrocarbons can be present in the hydrocarbon stream 1 in an amount of less than about 10 wt. % based on the total weight of the hydrocarbon stream 1. Alternatively, the $C_{6-8}$ aromatic hydrocarbons can be present in the hydrocarbon stream 1 in an amount of 10 wt. %, 20 wt. %, 30 wt. %, 40 wt. % or more, based on the total weight of the hydrocarbon stream 1. In some aspects, the hydrocarbon stream 1 comprises no $C_{6-8}$ aromatic hydrocarbons, e.g., the hydrocarbon stream 1 is substantially free of $C_{6-8}$ aromatic hydrocarbons.

Any paraffin may be included in the hydrocarbon stream 1. Examples of paraffins which may be included in the hydrocarbon stream 1 include, but are not limited to, $C_1$ to $C_{22}$ n-paraffins and i-paraffins. The paraffins can be present in the hydrocarbon stream 1 in an amount of less than 10 wt. % based on the total weight of the hydrocarbon stream 1. Alternatively, the paraffins can be present in the hydrocarbon stream 1 in an amount of 10 wt. %, 20 wt. %, 30 wt. %, 40 wt. %, 50 wt. %, 60 wt. %, or more based on the total weight of the hydrocarbon stream 1. While certain hydrocarbon streams include paraffins of carbon numbers up to 22, the disclosure is not limited to carbon number 22 as an upper end-point of the suitable range of paraffins, and the paraffins can include higher carbon numbers, e.g., 23, 24, 25, 26, 27, 28, 29, 30, 31, 32, 33, 34, 35, 36, 37, 38, 39, 40, and higher. In some aspects, at least a portion of the paraffins in the hydrocarbon stream 1 comprises at least a portion of the heavy hydrocarbon molecules (e.g., heavy hydrocarbon molecules that will undergo hydrocracking in the hydroprocessing reactor 10).

Any olefin may be included in the hydrocarbon stream 1. Examples of olefins which may be included in hydrocarbon stream 1 include, but are not limited to, $C_2$ to $C_{10}$ olefins and combinations thereof. The olefins can be present in the hydrocarbon stream 1 in an amount of less than 10 wt. % based on the total weight of the hydrocarbon stream 1. Alternatively, the olefins can be present in the hydrocarbon stream 1 in an amount of 10 wt. %, 20 wt. %, 30 wt. %, 40 wt. %, or more based on the total weight of the hydrocarbon stream 1. In some aspects, at least a portion of the one or more olefins in the hydrocarbon stream 1 comprise at least a portion of the heavy hydrocarbon molecules (e.g., heavy hydrocarbon molecules that will undergo hydrocracking in the hydroprocessing reactor 10). While certain hydrocarbon streams include olefins of carbon numbers up to 10, the disclosure is not limited to carbon number 10 as an upper end-point of the suitable range of olefins, and the olefins can include higher carbon numbers, e.g., 11, 12, 13, 14, 15, 16, 17, 18, 19, 20, 21, 22, 23, 24, 25, 26, 27, 28, 29, 30, and higher. In some aspects, the hydrocarbon stream 1 comprises no olefins, e.g., the hydrocarbon stream 1 is substantially free of olefins.

Any naphthene may be included in the hydrocarbon stream 1. Examples of naphthenes include, but are not limited to, cyclopentane, cyclohexane, cycloheptane, and cyclooctane. The naphthenes can be present in the hydrocarbon stream 1 in an amount of less than 10 wt. % based on the total weight of the hydrocarbon stream 1. Alternatively, the naphthenes can be present in the hydrocarbon stream 1 in an amount of 10 wt. %, 20 wt. %, 30 wt. %, 40 wt. %, or more based on the total weight of the hydrocarbon stream 1. While certain hydrocarbon streams include naphthenes of carbon numbers up to 8, the disclosure is not limited to carbon number 8 as an upper end-point of the suitable range of naphthenes, and the naphthenes can include higher carbon numbers, e.g., 9, 10, 11, 12, 13, 14, 15, 16, 17, 18, 19, 20, 21, 22, 23, 24, 25, 26, 27, 28, 29, 30, and higher. In some aspects, at least a portion of the naphthenes in the hydrocarbon stream 1 comprises at least a portion of the heavy hydrocarbon molecules (e.g., heavy hydrocarbon molecules that will undergo hydrocracking in the hydroprocessing reactor 10).

As discussed herein, the processes disclosed herein contemplate hydrocracking of molecules, and in particular, heavy hydrocarbon molecules of the hydrocarbon stream 1. The heavy hydrocarbon molecules can be present in the hydrocarbon stream 1 in an amount of less than 10 wt. % based on the total weight of the hydrocarbon stream 1. Alternatively, the heavy hydrocarbon molecules can be present in the hydrocarbon stream 1 in an amount of from 10 wt. % to 90 wt. %, based on the total weight of the hydrocarbon stream 1. As described above, the heavy hydrocarbon molecules may include paraffins, i-paraffins, olefins, naphthenes, or combinations thereof. In some aspects, the heavy hydrocarbon molecules may include $C_{16}$ and larger hydrocarbons. Greater than 5 wt. %, 10 wt. %, 15 wt. %, 20 wt. %, 25 wt. %, 30 wt. %, or more of the heavy hydrocarbon molecules in the hydrocarbon stream 1 are hydrocracked when the hydrocarbon stream 1 is contacted with the hydroprocessing catalyst in the hydroprocessing reactor 10. As will be appreciated by one of skill in the art, while the $C_9$+ aromatic hydrocarbons undergo a hydrodealkylation reaction, some $C_9$+ aromatic hydrocarbons can undergo hydrocracking. For example, greater than 10 wt. % of the $C_9$+ aromatic hydrocarbons in the hydrocarbon stream 1 are hydrocracked when the hydrocarbon stream 1 is contacted with the hydroprocessing catalyst in the hydroprocessing reactor 10.

Chloride compounds which may be included in the hydrocarbon stream 1 include, but are not limited to, aliphatic chlorine-containing hydrocarbons, aromatic chlorine-containing hydrocarbons, and other chlorine-containing hydrocarbons. Examples of chlorine-containing hydrocarbons include, but are not limited to, 1-chlorohexane ($C_6H_{13}Cl$), 2-chloropentane ($C_5H_{11}Cl$), 3-chloro-3-methyl pentane ($C_6H_{13}Cl$), (2-chloroethyl) benzene ($C_8H_9Cl$), chlorobenzene ($C_6H_5Cl$), or combinations thereof. The chloride compounds can be present in the hydrocarbon stream 1 in an amount of 5 ppm, 6 ppm, 7 ppm, 8 ppm, 9 ppm, 10 ppm, 15 ppm, 20 ppm, 30 ppm, 40 ppm, 50 ppm, 100 ppm, 200 ppm, 300 ppm, 400 ppm, 500 ppm, 600 ppm, 700 ppm, 800 ppm, 900 ppm, 1,000 ppm, 1,100 ppm, 1,200 ppm, 1,300 ppm, 1,400 ppm, 1,500 ppm, 1,600 ppm, 1,700 ppm, 1,800 ppm, 1,900 ppm, 2,000 ppm, or more based on the total weight of the hydrocarbon stream 1.

One or more chloride compounds can be added to the hydrocarbon stream 1 (e.g., the hydrocarbon stream 1 is "doped" with one or more chlorides), for example, via a doping stream 7, before the hydrocarbon stream 1 is introduced to the hydroprocessing reactor 10. One or more chlorides can be added to the hydrocarbon stream 1 in an amount such that a chloride content of the hydrocarbon stream 1, after chloride addition, is about equal to or greater than about 5 ppm chloride, or more based on the total weight of the hydrocarbon stream 1.

Sulphide compounds or sulphides which may be included in the hydrocarbon stream 1 include sulphur-containing compounds. For example, a sulphiding agent such as dimethyl disulphide ($C_2H_6S_2$), dimethyl sulphide ($C_2H_6S$), mercaptans (R—SH), carbon disulphide ($CS_2$), hydrogen sulphide ($H_2S$), or combinations thereof may be used as the sulphide in the hydrocarbon stream 1.

One or more sulphides (e.g., dimethyl disulphide ($C_2H_6S_2$), dimethyl sulphide ($C_2H_6S$), mercaptans (R—SH), carbon disulphide ($CS_2$), hydrogen sulphide ($H_2S$), or combinations thereof) can be added to the hydrocarbon stream 1 (e.g., the hydrocarbon stream 1 is "doped" with one or more sulphides), for example, via a doping stream 7, before the hydrocarbon stream 1 is introduced to the hydroprocessing reactor 10. One or more sulphides can be added to the hydrocarbon stream 1 in an amount such that a sulphur (S) content of the hydrocarbon stream 1, after sulphide addition, is about 0.05 wt. %, 0.1 wt. %, 0.5 wt. %, 1 wt. %, 1.5 wt. %, 2 wt. %, 2.5 wt. %, 3 wt. %, 3.5 wt. %, 4 wt. %, 4.5 wt. %, 5 wt. %, or more based on the total weight of the hydrocarbon stream 1. The doping stream 7 may further include components tailored for doping such as hexadecane and dimethyl disulphide; alternatively, the doping stream 7 may be a heavier oil (e.g., naphtha, diesel, or both) which already contains sulphide compounds (or to which sulphides are doped to achieve the sulphur content disclosed herein) and which is blended with the hydrocarbon stream 1 to achieve the sulphur content described above.

Alternatively, one or more sulphides are present in the hydrocarbon stream 1 as a result of upstream processing from which the hydrocarbon stream 1 flows. The hydrocarbon stream 1 may contain one or more sulphides in an amount such that a sulphur content of the hydrocarbon stream 1, without sulphide doping, is about 0.05 wt. %, 0.1 wt. %, 0.5 wt. %, 1 wt. %, 1.5 wt. %, 2 wt. %, 2.5 wt. %, 3 wt. %, 3.5 wt. %, 4 wt. %, 4.5 wt. %, 5 wt. % or more based on the total weight of the hydrocarbon stream 1.

Alternatively, the hydrocarbon stream 1 may contain one or more sulphides in an amount insufficient for sulphiding (e.g., less than 5,000, 4,000, 3,000, 2,000, 1,000, 900, 800, 700, 600, 500, 400, 300, 200, 100, 90, 80, 70, 60, 50, 40, 30, 20, 10, 5, or 1 ppm) the hydroprocessing catalyst contained in the hydroprocessing reactor 10 (the catalyst is discussed in more detail later herein), and doping stream 7 is utilized to raise the amount of one or more sulphides in the hydrocarbon stream such that a sulphur content of the hydrocarbon stream 1, after sulphide addition, is about 0.05 wt. %, 0.1 wt. %, 0.5 wt. %, 1 wt. %, 1.5 wt. %, 2 wt. %, 2.5 wt. %, 3 wt. %, 3.5 wt. %, 4 wt. %, 4.5 wt. %, 5 wt. %, or more based on the total weight of the hydrocarbon stream 1.

The sulphur content of the hydrocarbon stream 1, after sulphide addition using doping stream 7 or without sulphide addition using doping stream 7, is up to about 3 wt. %, based on the total weight of the hydrocarbon stream 1.

The sulphur present in the hydrocarbon stream 1 can be removed as $H_2S$ from streams downstream of the hydroprocessing reactor 10 (e.g., stream 2), to provide a reduced level of sulphur acceptable for processing in steam crackers and/or refinery units.

The hydroprocessing reactor 10 is configured to hydrodealkylate, and in some configurations, additionally hydrocrack, dechlorinate and hydrogenate components of the hydrocarbon stream 1 fed to the hydroprocessing reactor 10. In the hydroprocessing reactor 10, the hydrocarbon stream 1 is contacted with the hydroprocessing catalyst in the presence of hydrogen to yield a hydrocarbon product in stream 2. It is contemplated the hydrocarbon stream 1 may be contacted with the hydroprocessing catalyst in upward flow, downward flow, radial flow, or combinations thereof, with or without a staged addition of hydrocarbon stream 1, doping stream 7, a $H_2$ stream, or combinations thereof. It is further contemplated the components of the hydrocarbon stream 1 may be in the liquid phase, a liquid-vapor phase, or a vapor phase while in the hydroprocessing reactor 10.

The hydroprocessing reactor 10 may facilitate any suitable reaction of the components of the hydrocarbon stream 1 in the presence of, or with, hydrogen. Reactions in the hydroprocessing reactor 10 include a hydrodealkylation reaction of $C_9$+ aromatic hydrocarbons, wherein the $C_9$+ aromatic hydrocarbons in the presence of hydrogen form lower molecular weight aromatic hydrocarbons (e.g., $C_{6-8}$ aromatic hydrocarbons) and alkanes. For example, trimethylbenzenes can undergo a hydrodealkylation reaction to produce xylenes and methane. Other reactions may occur in the hydroprocessing reactor 10, such as the addition of hydrogen atoms to double bonds of unsaturated molecules (e.g., olefins, aromatic compounds), resulting in saturated molecules (e.g., paraffins, i-paraffins, naphthenes). Additionally, reactions in the hydroprocessing reactor 10 may cause a rupture of a bond of an organic compound, resulting in "cracking" of a hydrocarbon molecule into two or more smaller hydrocarbon molecules, or resulting in a subsequent reaction and/or replacement of a heteroatom with hydrogen. Examples of reactions which may occur in the hydroprocessing reactor 10 include, but are not limited to, hydrodealkylation of $C_9$+ aromatic hydrocarbons, the hydrogenation of olefins, removal of heteroatoms from heteroatom-containing hydrocarbons (e.g., dechlorination), hydrocracking of large paraffins or i-paraffins to smaller hydrocarbon molecules, hydrocracking of aromatic hydrocarbons to smaller cyclic or acyclic hydrocarbons, conversion of one or more aromatic compounds to one or more cycloparaffins, isomerization of one or more normal paraffins to one or more i-paraffins, selective ring opening of one or more cycloparaffins to one or more i-paraffins, or combinations thereof.

The hydroprocessing reactor 10 may be any vessel configured to contain the hydroprocessing catalyst disclosed herein. The vessel may be configured for gas phase, liquid phase, vapor-liquid phase, or slurry phase operation. The hydroprocessing reactor 10 may include one or more beds of the hydroprocessing catalyst in fixed bed, fluidized bed, moving bed, ebullated bed, slurry bed, or combinations thereof. The hydroproces sing reactor 10 may be operated adiabatically, isothermally, nonadiabatically, non-isothermally, or combinations thereof. The reactions of this disclosure may be carried out in a single stage or in multiple stages. For example, the hydroprocessing reactor 10 can be two reactor vessels fluidly connected in series, each having one or more catalyst beds of the hydroprocessing catalyst. Alternatively, two or more stages for hydroprocessing may be contained in a single reactor vessel. When multiple stages are employed, a first stage may hydrodealkylate, crack, dechlorinate and hydrogenate components of the hydrocarbon stream 1 to yield a first hydrocarbon product having a first level of $C_9$+ aromatic hydrocarbons, chloride compounds and olefins. The first hydrocarbon product may flow from the first stage to a second stage, where other components of the first hydrocarbon product are hydrodealkylated, cracked, dechlorinated and hydrogenated to yield a second hydrocarbon product stream (stream 2 in the FIGURE) having a second level of $C_9$+ aromatic hydrocarbons, chloride compounds and olefins. The second hydrocarbon stream may then be treated as described herein for stream 2.

The hydroprocessing reactor 10 may comprise one or more vessels. Hydroprocessing processes and reactors suitable for use in the present disclosure are described in more detail in U.S. patent application Ser. Nos. 15/085,278; 15/085,311; 15/085,379; 15/085,402; 15/085,445; each of which is incorporated by reference herein in its entirety.

Hydrogen may feed to the hydroprocessing reactor 10 in stream 8. The rate of hydrogen addition to the hydroprocessing reactor 10 is generally sufficient to achieve hydrogen-to-hydrocarbon ratios disclosed herein.

The disclosed hydroprocessing reactor 10 may operate at various process conditions. For example, contacting the hydrocarbon stream 1 with the hydroprocessing catalyst in the presence of hydrogen may occur in the hydroprocessing reactor 10 at a temperature of 100° C. to 550° C.; alternatively, 100° C. to 400° C.; or alternatively, 260° C. to 350° C. Contacting the hydrocarbon stream 1 with the hydroprocessing catalyst in the presence of hydrogen may occur in the hydroprocessing reactor 10 at a weight hourly space velocity (WHSV) of between 0.1 $hr^{-1}$ to 10 $hr^{-1}$; or alternatively, 1 $hr^{-1}$ to 3 $hr^{-1}$. Contacting the hydrocarbon stream 1 with the hydroprocessing catalyst in the presence of hydrogen may occur in the hydroprocessing reactor 10 at a hydrogen-to-hydrocarbon ($H_2$/HC) flow ratio of 10 to 3,000 NL/L; or alternatively, 200 to 800 NL/L.

Contacting the hydrocarbon stream 1 with the hydroprocessing catalyst in the presence of hydrogen may occur in the hydroprocessing reactor 10 at a pressure of 1 bar absolute (bara) to 200 barg; alternatively, 1 bara to 60 barg; or alternatively, 10 barg to 45 barg. Without wishing to be limited by theory, at lower pressures and higher temperatures hydrodealylation is favored as compared to hydrocracking.

It is contemplated that dechlorination using the hydroprocessing catalyst as described herein is performed in the hydroprocessing reactor 10 without the use of chlorine sorbents, without addition of $Na_2CO_3$ in an effective amount to function as a dechlorinating agent, or both.

The hydroprocessing catalyst may be any catalyst used for hydrogenation (e.g., saturation) of olefins and aromatic hydrocarbons (e.g., a commercially available hydrotreating catalyst). Nonlimiting examples of hydroprocessing catalysts suitable for use in the present disclosure include cobalt and molybdenum on an alumina support, nickel and molybdenum on an alumina support, tungsten and molybdenum on an alumina support, platinum and palladium on an alumina support, nickel sulphides, nickel sulphides on an alumina support, molybdenum sulphides, molybdenum sulphides on an alumina support, nickel and molybdenum sulphides, nickel and molybdenum sulphides on an alumina support, oxides of cobalt and molybdenum, oxides of cobalt and molybdenum on an alumina support, and the like, or combinations thereof. As will be appreciated by one of skill in the art, and with the help of this disclosure, un-supported catalysts can be used as well, for example in a slurry hydroprocessing reactor.

In configurations where the hydrocarbon stream 1 comprises one or more sulphides and one or more chloride compounds, contacting the hydrocarbon carbon stream 1 with the hydroprocessing catalyst acts to activate the hydroprocessing catalyst by sulphiding and to acidify the hydroprocessing catalyst by chlorinating. Continuously contacting the hydroprocessing catalyst with the hydrocarbon stream 1 containing one or more sulphides, one or more chloride compounds, or both, may maintain catalyst activity on a continuous basis. For purposes of the disclosure herein, the term "catalyst activity" or "catalytic activity" with respect to the hydroprocessing catalyst refers to the ability of the hydroprocessing catalyst to catalyze hydroprocessing reactions, such as hydrodealkylation reactions, hydrocracking reactions, hydrodechlorination reactions, etc.

The hydroprocessing catalyst can be activated in-situ and/or ex-situ by contacting the hydroprocessing catalyst with a stream (e.g., hydrocarbon stream 1, doping stream 7, catalyst activating stream 9, etc.) containing sulphides and/or chlorides, and wherein the hydroprocessing catalyst is activated for simultaneous dehydrochlorination, hydrocracking and hydrodealkylation.

In an aspect, the hydroprocessing catalyst is activated and/or the activity is maintained by sulphiding the hydroprocessing catalyst in-situ. For example, the hydroprocessing catalyst may be sulphided (i.e., activated) and/or sulphiding (i.e., maintaining the catalyst activity) of the hydroprocessing catalyst may be performed (e.g., maintaining the hydroprocessing catalyst in sulphided form is accomplished) by continuously contacting the hydrocarbon stream 1 containing one or more sulphides with the hydroprocessing catalyst.

Alternatively, the hydroprocessing catalyst may be sulphided (i.e., activated) by contacting a catalyst activating stream 9 containing one or more sulphides with the hydroprocessing catalyst for a period of time (e.g., 1, 2, 3, 4, 5, 6, 7, 8, 9 or more hours) sufficient to activate the hydroprocessing catalyst (before contacting the hydrocarbon stream 1 with the hydroprocessing catalyst). The catalyst activating stream 9 may include a hydrocarbon carrier for one or more sulphides, such as hexadecane. One or more sulphides may be included in the catalyst activating stream 9 in an amount such that the sulphur content of the catalyst activating stream 9 is about 0.05 wt. %, 0.1 wt. %, 0.5 wt. %, 1 wt. %, 1.5 wt. %, 2 wt. %, 2.5 wt. %, 3 wt. %, 3.5 wt. %, 4 wt. %, 4.5 wt. %, 5 wt. % or more, based on the total weight of the catalyst activating stream 9. The sulphur content of the catalyst activating stream 9 can be up to about 3 wt. %, based on the total weight of the catalyst activating stream 9. The hydroprocessing catalyst may be contacted with the catalyst activating stream 9 in-situ and/or ex-situ.

When the hydroprocessing catalyst is activated in-situ, after the hydroprocessing catalyst is activated with the catalyst activating stream 9, flow of the catalyst activating stream 9 may be discontinued, and sulphiding (i.e., maintaining the catalyst activity) of the hydroprocessing catalyst may be maintained (e.g., maintaining the hydroprocessing catalyst in sulphided form is accomplished) by continuously contacting the hydrocarbon stream 1 containing one or more sulphides with the hydroprocessing catalyst.

Catalyst activity is also maintained by chloriding the hydroprocessing catalyst. The hydroprocessing catalyst is chlorided using one or more chloride compounds provided to the hydroprocessing catalyst by the hydrocarbon stream 1. One or more chloride compounds which contribute to acidification of the hydroprocessing catalyst may be included in the hydrocarbon stream 1 in amounts disclosed herein. When the hydrocarbon stream contains no chlorides, one or more chlorides can be added to the hydrocarbon stream 1 in an amount of equal to or greater than about 5 ppm chloride, based on the total weight of the hydrocarbon stream 1.

Due to hydrodealkylation reactions in the hydroprocessing reactor 10, an amount of $C_9$+ aromatic hydrocarbons in the hydrocarbon product stream 2 is less than an amount of $C_9$+ aromatic hydrocarbons in the hydrocarbon stream 1 by from about 5% to about 95%, based on the total weight of $C_9$+ aromatic hydrocarbons in the hydrocarbon stream 1. As will be appreciated by one of skill in the art, and with the help of this disclosure, a decrease in the amount of $C_9$+ aromatic hydrocarbons between the hydrocarbon stream 1 and the hydrocarbon product stream 2 is also due to hydrocracking reactions, as well as hydrogenation reactions that the $C_9$+ aromatic hydrocarbons participate in the hydroprocessing reactor 10, in addition to hydrodealkylation reactions that the $C_9$+ aromatic hydrocarbons participate in the hydroprocessing reactor 10.

Further, the hydrocarbon product stream 2 may contain an amount of $C_{6-8}$ aromatic hydrocarbons that is greater than an amount of $C_{6-8}$ aromatic hydrocarbons in the hydrocarbon stream 1. As will be appreciated by one of skill in the art, and with the help of this disclosure, the increase in the amount of $C_{6-8}$ aromatic hydrocarbons between the hydrocarbon stream 1 and the hydrocarbon product stream 2 is dependent on the aromatic content of the hydrocarbon stream 1.

It is contemplated that a total amount of aromatic hydrocarbons in the hydrocarbon product stream 2 is less than a total amount of aromatic hydrocarbons in the hydrocarbon stream 1 due to hydrogenation and/or hydrocracking of at least a portion of the aromatic hydrocarbons in the hydroprocessing reactor 10, although at least a portion of the $C_9$+ aromatic hydrocarbons is hydrodealkylated to produce $C_{6-8}$ aromatic hydrocarbons. As will be appreciated by one of skill in the art, and with the help of this disclosure, while $C_{6-8}$ aromatic hydrocarbons are produced by the hydrodealkylation reactions, a portion of the $C_{6-8}$ aromatic hydrocarbons present in the hydroprocessing reactor 10 (whether produced via hydrodealkylation or introduced via hydrocarbon stream 1) will undergo hydrogenation and/or hydrocracking.

Further, due to hydrogenation reactions in the hydroprocessing reactor 10, the hydrocarbon product stream 2 may contain one or more olefins in an amount of less than 1 wt. %, based on the total weight of the hydrocarbon product stream 2.

The reaction product flows as effluent from the hydroprocessing reactor 10 in the hydrocarbon product stream 2 to the separator 20. Separator 20 may be any suitable vessel which can recover a treated hydrocarbon stream 4 from the hydrocarbon product 2, wherein at least a portion of the treated hydrocarbon stream 4 is fed to the separator 20. The treated hydrocarbon stream 4 may be recovered by separating a treated product (e.g., liquid product or gas product) from a sulphur and chlorine-containing gas (e.g., stream 3) in the separator 20, and flowing the treated product in the treated hydrocarbon stream 4 from the separator 20.

In some configurations, the separator 20 can be a condenser which operates at conditions which condense a portion of the hydrocarbon product stream 2 into the treated product (e.g., liquid product or treated liquid product) while leaving sulphur and chlorine-containing compounds in the gas phase. The treated liquid product flows from the separator 20 in treated hydrocarbon stream 4, and the sulphur and chlorine-containing gas flows from the separator 20 via stream 3.

In other configurations, the separator 20 can be a scrubbing unit containing a caustic solution (e.g., a solution of sodium hydroxide in water) which removes (e.g., via reaction, adsorption, absorption, or combinations thereof) sulphur and chlorine-containing gases from the hydrocarbon product stream 2 to yield the treated product (e.g., gas product or treated gas product) which flows from the separator 20 via treated hydrocarbon stream 4 while the sulphur and chlorine-containing compounds in the gas phase flow from the separator 20 via chloride and sulphur stream 3.

In yet other configurations, the separator 20 can be a condenser in communication with a scrubbing unit containing a caustic solution. As described above, the condenser may operate at conditions which condense a portion of the hydrocarbon product stream 2 into a mid-treated product (e.g., liquid product or treated liquid product) while leaving sulphur and chlorine-containing compounds in the gas phase. The mid-treated liquid product flows from the condenser and experiences a pressure reduction (e.g., via a valve or other pressure reducing device known in the art with the aid of this disclosure) which creates an effluent gas which flows to the scrubbing unit, along with the previously separated gas phase containing sulphur and chlorine-containing compounds, leaving the treated product flowing in treated hydrocarbon stream 4. Sulphur and chlorine-containing compounds flow from the separator 20 in stream 3.

In still yet other configurations, the separator 20 can be a condenser and/or a scrubbing unit containing a caustic solution as described above, wherein an intermediate treated product stream may be recovered by separating an intermediate treated product (e.g., liquid product or gas product) from a sulphur and chlorine-containing gas (e.g., stream 3) in the separator 20, as described above for the treated hydrocarbon stream 4, and flowing the intermediate treated product in an intermediate treated hydrocarbon stream from the separator 20. The intermediate treated hydrocarbon stream can flow from the separator 20 to a distillation column to produce a treated hydrocarbon stream characterized by a boiling end point of less than about 370° C. and a heavy treated hydrocarbon stream characterized by a boiling end point of equal to or greater than about 370° C. In such configurations, at least a portion of the treated hydrocarbon stream characterized by a boiling end point of less than about 370° C. can be fed to a steam cracker, such as steam cracker 30, as will be described in more detail later herein. At least a portion of the heavy treated hydrocarbon stream can be recycled to the hydroprocessing reactor 10, for example via hydrocarbon stream 1. As will be appreciated by one of skill in the art, and with the help of this disclosure, no halide containing compounds are recycled to the hydroprocessing reactor 10 or only trace halide compounds are recycled to the hydroprocessing reactor 10 (depending on the dehydrohalogenation efficiency), as such compounds are removed in separator 20.

The treated hydrocarbon stream 4 that is fed to the stream cracker 30 meets steam cracker feed requirements for chloride content, sulphur content, olefin content, and boiling end point. As previously described herein, the composition of the treated hydrocarbon stream 4 can vary depending on whether the optional polishing unit 25 is used or not.

The treated hydrocarbon stream 4 can include one or more chloride compounds in an amount of less than 15 ppm, 14 ppm, 13 ppm, 12 ppm, 11 ppm, 10 ppm, 9 ppm, 8 ppm, 7 ppm, 6 ppm, 5 ppm, 4 ppm, 3 ppm, 2 ppm, 1 ppm, or 0.5 ppm, based on the total weight of the treated hydrocarbon stream 4. It is contemplated that one or more chloride compounds in the treated hydrocarbon stream 4 may be the same as some or all of one or more chloride compounds in the hydrocarbon stream 1; alternatively, it is contemplated that only some of one or more chloride compounds in the treated hydrocarbon stream 4 are the same as only some of one or more chloride compounds in the hydrocarbon stream 1; or alternatively, it is contemplated that none of one or more chloride compounds in the treated hydrocarbon stream 4 are the same as one or more chloride compounds in the hydrocarbon stream 1. Without wishing to be limited by theory, at least a portion of one or more chloride compounds in the hydrocarbon stream 1 can participate in reactions (e.g., dehydrochlorination reactions) that lead to one or more chloride compounds in the treated hydrocarbon stream 4 that are different than one or more chloride compounds in the hydrocarbon stream 1.

As will be appreciated by one of skill in the art, and with the help of this disclosure, when the treated hydrocarbon stream 4 is obtained by chloride and sulphide removal, a wt. % concentration of individual components other than chlorides and sulphides is altered to a low extent, wherein a wt. % concentration of individual components other than chlorides and sulphides is slightly greater in the treated hydrocarbon stream 4 than in the hydrocarbon product stream 2 (e.g., about 1% greater). Further, as will be appreciated by one of skill in the art, and with the help of this disclosure, the wt. % concentration of components such as olefins and $C_9$+ aromatic hydrocarbons in the treated hydrocarbon stream 4 is less than a corresponding wt. % concentration of components (e.g., olefins and $C_9$+ aromatic hydrocarbons, respectively) in the hydrocarbon stream 1, owing to hydrogenation and hydrodealkylation reactions in the hydroprocessing reactor 10. Further, as will be appreciated by one of skill in the art, and with the help of this disclosure, the wt. % concentration of components such as paraffins and $C_{6-8}$ aromatic hydrocarbons in the treated hydrocarbon stream 4 is greater than a corresponding wt. % concentration of components (e.g., paraffins and $C_{6-8}$ aromatic hydrocarbons, respectively) in the hydrocarbon stream 1, owing to both component separation from the hydrocarbon product stream 2, and hydrocracking and hydrodealkylation reactions in the hydroprocessing reactor 10.

As will be appreciated by one of skill in the art, and with the help of this disclosure, when the treated hydrocarbon stream 4 is obtained by chloride and sulphide removal, as well as by separation of a heavy treated hydrocarbon stream with a boiling end point of equal to or greater than about 370° C., a wt. % concentration of individual components other than chlorides and sulphides can be altered to a significant extent, wherein a wt. % concentration of individual components other than chlorides, sulphides, and molecules with a boiling point of equal to or greater than about 370° C., is greater in the treated hydrocarbon stream 4 than in the hydrocarbon product stream 2 (e.g., by about 5% or greater). Further, as will be appreciated by one of skill in the art, and with the help of this disclosure, the wt. % concentration of components such as olefins and $C_9$+ aromatic hydrocarbons in the treated hydrocarbon stream 4 is less than a corresponding wt. % concentration of components (e.g., olefins and $C_9$+ aromatic hydrocarbons, respectively) in the hydrocarbon stream 1, owing to hydrogenation and hydrodealkylation reactions in the hydroprocessing reactor 10, as well as to separation and removal of $C_9$+ aromatic hydrocarbons with a boiling end point of equal to or greater than about 370° C. from the hydrocarbon product stream 2. Further, as will be appreciated by one of skill in the art, and with the help of this disclosure, the wt. % concentration of components such as paraffins with a boiling point of less than about 370° C. and $C_{6-8}$ aromatic hydrocarbons in the treated hydrocarbon stream 4 is greater than a corresponding wt. % concentration of components (e.g., paraffins with a boiling point of less than about 370° C. and $C_{6-8}$ aromatic hydrocarbons, respectively) in the hydrocarbon stream 1, owing to both component separation from the hydrocarbon product stream 2, and hydrocracking and hydrodealkylation reactions in the hydroprocessing reactor 10.

The treated hydrocarbon stream 4 can include one or more olefins in an amount which is less than an amount of one or more olefins in the hydrocarbon stream 1 due to hydrogenation of at least a portion of one or more olefins from the hydrocarbon stream 1 while the hydrocarbon stream 1 is contacted with the hydroprocessing catalyst in the hydroprocessing reactor 10. Further, the treated hydrocarbon stream 4 includes one or more olefins in an amount which is less than an amount of one or more olefins in the hydrocarbon stream 1 due to hydrogenation and hydrocracking of at least a portion of one or more olefins from the hydrocarbon stream 1 while the hydrocarbon stream 1 is contacted with the hydroprocessing catalyst in the hydroprocessing reactor 10. One or more olefins can be present in the treated hydrocarbon stream 4 in an amount of less than 1 wt. %, based on the total weight of the treated hydrocarbon stream 4.

The treated hydrocarbon stream 4 can include $C_9$+ aromatic hydrocarbons in an amount which is less than an amount of $C_9$+ aromatic hydrocarbons in the hydrocarbon stream 1 due to hydrodealkylation of at least a portion of the $C_9$+ aromatic hydrocarbons from the hydrocarbon stream 1 while the hydrocarbon stream 1 is contacted with the hydroprocessing catalyst in the hydroprocessing reactor 10. The reduction in the amount of $C_9$+ aromatic hydrocarbons can be further due to separation and removal of $C_9$+ aromatic hydrocarbons with a boiling end point of equal to or greater than about 370° C. from the hydrocarbon product stream 2.

The treated hydrocarbon stream 4 can include $C_{6-8}$ aromatic hydrocarbons, wherein an amount of $C_{6-8}$ aromatic hydrocarbons in the treated hydrocarbon stream 4 is greater than an amount of $C_{6-8}$ aromatic hydrocarbons in the hydrocarbon stream 1 due to hydrodealkylating of at least a portion of $C_9$+ aromatic hydrocarbons from the hydrocarbon stream 1 in the hydroprocessing reactor 10. In some aspects, an amount of $C_{6-8}$ aromatic hydrocarbons in the treated hydrocarbon stream 4 is increased by equal to or greater than at least 1 wt. %, 2 wt. %, 3 wt. %, 4 wt. %, 5 wt. % or more, when compared to an amount of $C_{6-8}$ aromatic hydrocarbons in the hydrocarbon stream 1, wherein the increase in the amount of $C_{6-8}$ aromatic hydrocarbons is due to (i) hydrodealkylating of at least a portion of $C_9$+ aromatic hydrocarbons from the hydrocarbon stream 1 in the hydroprocessing reactor 1 and/or (ii) to hydrocracking of saturated compounds, such as n-paraffin (e.g., hexadecane).

It is contemplated that a total amount of aromatic hydrocarbons in the treated hydrocarbon stream 4 is less than a total amount of aromatic hydrocarbons in the hydrocarbon stream 1 due to hydrogenation and/or hydrocracking of at least a portion of the aromatic hydrocarbons in the hydroprocessing reactor 10, although at least a portion of the $C_9$+ aromatic hydrocarbons is hydrodealkylated to produce $C_{6-8}$ aromatic hydrocarbons. For example, aromatic hydrocarbons may be present in the treated hydrocarbon stream 4 in an amount of less than about 50 wt. % based on the total weight of the treated hydrocarbon stream 4.

Due to hydrocracking of heavy hydrocarbon molecules when the hydrocarbon stream 1 is contacted with the hydroprocessing catalyst in the hydroprocessing reactor 10, the treated hydrocarbon stream 4 may have a boiling end point of 370° C. or less. A significant reduction in hydrocarbons boiling above 370° C. is obtained in stream 2 as compared to hydrocarbon stream 1, thereby leading to the recovery of a treated hydrocarbon stream 4 with a boiling end point of 370° C. or less.

When the treated hydrocarbon stream 4 includes one or more chloride compounds in an amount of less than 10 ppm, the treated hydrocarbon stream 4 may be fed directly to the steam cracker 30. In alternative configurations where the treated hydrocarbon stream 4 includes one or more chloride compounds in an amount of 10 ppm or more (e.g., 10 ppm to 15 ppm), the treated hydrocarbon stream 4 may be blended with a non-chlorinated hydrocarbon stream 5 to yield a blended hydrocarbon stream 4' (streams 4' and 5 are depicted with dashed lines to denote the alternative configuration) having an amount of one or more chlorides which is less than 10 ppm, based on the total weight of the blended hydrocarbon stream 4'. The blended hydrocarbon stream 4' may be fed to the steam cracker 30. As will be appreciated by one of skill in the art, and with the help of this disclosure, the non-chlorinated hydrocarbon stream 5 dilutes the chloride content of treated hydrocarbon stream 4, thereby resulting in a blended hydrocarbon stream 4' that meets steam cracker feed requirements for chloride content. The non-chlorinated hydrocarbon stream 5 can generally comprise paraffins, iso-paraffins, naphthenes and aromatics. The non-chlorinated hydrocarbon stream 5 is substantially free of chloride, and olefins.

A typical non-chlorinated hydrocarbon stream used as the non-chlorinated hydrocarbon stream 5 could be any suitable naphtha and gas condensate steam cracker feed. For example, a typical wide-range naphtha feed that can be used as a steam cracker feed can be a PIONA feed having P/I/O/N/A composition of 35.9 vol. % P/36 vol. % I/0.5 vol. % O/22.1 vol. % N/5.5 vol. % A, with an American Petroleum Institute (API) gravity of 70.4, a sulphur content of 161 ppm, an initial boiling point (IBP) of 35° C., and a final boiling point (FBP) of 183° C. Generally, API gravity is a measure of how heavy or light a petroleum liquid is compared to water.

As another example, a typical non-chlorinated hydrocarbon stream used as the non-chlorinated hydrocarbon stream 5 could be atmospheric gas oils, which can typically have an API gravity of 37.4, an IBP/95% boiling/FBP as 216.1° C./361.7° C./378.9° C., and a sulphur content of 250-400 ppm.

Steam cracker 30 generally has feed specification requirements. First, the steam cracker 30 requires the amount of chloride compounds in the feed to the steam cracker 30 to be less than 10 ppm. Second, the steam cracker 30 requires the amount of olefins in a stream fed to the steam cracker 30 to be less than 1 wt. %. Third, the steam cracker 30 requires the boiling end point of the stream fed to the steam cracker 30 to be 370° C. The steam cracker 30 cracks molecules or cleaves at elevated temperatures carbon-carbon bonds of the components in the treated hydrocarbon stream 4 or blended hydrocarbon stream 4' in the presence of steam to yield high value products such as ethylene, propylene, butene, butadiene, aromatic compounds, or combinations thereof. The high value products may flow from the steam cracker 30 via stream 6.

A process for hydroprocessing a hydrocarbon stream comprising simultaneous dehydrochlorination, hydrocracking, and hydrodealkylation of the hydrocarbon stream as disclosed herein can comprise the steps of (a) contacting the hydrocarbon stream containing chlorides and sulphides with a hydroprocessing catalyst comprising a cobalt and molybdenum catalyst (Co-Mo catalyst) on an alumina support in the presence of hydrogen to yield a hydrocarbon product;

wherein the hydrocarbon stream comprises (i) one or more chloride compounds in an amount of equal to or greater than about 10 ppm chloride, based on the total weight of the hydrocarbon stream; (ii) one or more sulphide compounds in an amount of from about 0.05 wt. % to about 5 wt. % sulfur (S), based on the total weight of the hydrocarbon stream; (iii) $C_5$ to $C_8$ hydrocarbons; (iv) heavy hydrocarbon molecules, wherein the heavy hydrocarbon molecules include $C_9$ and higher non-aromatics; and (v) $C_9$+ aromatic hydrocarbons, wherein the $C_9$+ aromatic hydrocarbons include $C_9$ and higher aromatics; and (b) recovering a treated hydrocarbon stream from the hydrocarbon product; wherein the treated hydrocarbon stream comprises one or more chloride compounds in an amount of less than about 10 ppm chloride, based on the total weight of the treated hydrocarbon stream, and wherein a decrease in one or more chloride compounds is due to dehydrochlorination of the hydrocarbon stream during the step (a) of contacting; wherein the treated hydrocarbon stream comprises heavy hydrocarbon molecules, and wherein an amount of heavy hydrocarbon molecules in the treated hydrocarbon stream is less than an amount of heavy hydrocarbon molecules in the hydrocarbon stream due to hydrocracking of at least a portion of heavy hydrocarbon molecules from the hydrocarbon stream during the step (a) of contacting; wherein the treated hydrocarbon stream comprises $C_9$+ aromatic hydrocarbons, wherein an amount of $C_9$+ aromatic hydrocarbons in the treated hydrocarbon stream is less than an amount of $C_9$+ aromatic hydrocarbons in the hydrocarbon stream due to hydrodealkylating and/or hydrocracking of at least a portion of $C_9$+ aromatic hydrocarbons from the hydrocarbon stream during the step (a) of contacting, and wherein an amount of $C_{6-8}$ aromatic hydrocarbons in the treated hydrocarbon stream is greater than an amount of $C_{6-8}$ aromatic hydrocarbons in the hydrocarbon stream due to hydrodealkylating of at least a portion of $C_9$+ aromatic hydrocarbons and/or hydrocracking of at least a portion of heavy hydrocarbon molecules from the hydrocarbon stream during the step (a) of contacting. The hydroprocessing catalyst is activated in-situ and/or ex-situ for simultaneous dehydrochlorination, hydrocracking and hydrodealkylation by contacting the hydroproces sing catalyst with a stream containing sulphides and chlorides. The Co-Mo catalyst can be activated by sulphiding the catalyst, for example by contacting the catalyst with a straight run or uncracked hydrocarbon stream doped with sulphide compounds. The Co-Mo catalyst can also be activated by chloriding, for example by contacting the catalyst with a feed (e.g., a hydrocarbon stream, such as hydrocarbon stream 1 in the FIGURE) containing chloride compounds and sulphide compounds. The feed used for activation by chloriding can be a straight run feed, a cracked feed and/or a chloride containing feed, such as a plastic pyrolysis oil. In aspects where the feed does not contain chlorides, the feed can be spiked with chloride compounds, so that it can be used as an activating feed.

A process for processing plastic waste can comprise the steps of (a) converting a plastic waste to a hydrocarbon stream, wherein the plastic waste contains polyolefins, polystyrenes, PET, PVC, PVDC, and the like, or combinations thereof, and wherein the hydrocarbon stream comprises (i) one or more chloride compounds in an amount of equal to or greater than about 10 ppm chloride, based on the total weight of the hydrocarbon stream; (ii) one or more sulphide compounds in an amount of from about 0.05 wt. % to about 5 wt. % sulfur (S), based on the total weight of the hydrocarbon stream; (iii) $C_5$ to $C_8$ hydrocarbons; (iv) heavy hydrocarbon molecules, wherein the heavy hydrocarbon molecules include $C_9$ and higher non-aromatics; and (v) $C_9$+ aromatic hydrocarbons, wherein the $C_9$+ aromatic hydrocarbons include $C_9$ and higher aromatics; (b) contacting at least a portion of the hydrocarbon stream with a hydroprocessing catalyst in the presence of hydrogen to yield a hydrocarbon product, wherein the hydroprocessing catalyst comprises a cobalt and molybdenum catalyst (Co—Mo catalyst) on an alumina support; (c) recovering a treated hydrocarbon stream from the hydrocarbon product; wherein the treated hydrocarbon stream comprises one or more chloride compounds in an amount of less than about 10 ppm chloride, based on the total weight of the treated hydrocarbon stream, and wherein a decrease in one or more chloride compounds is due to dehydrochlorination of the hydrocarbon stream during the step (b) of contacting; wherein the treated hydrocarbon stream comprises heavy hydrocarbon molecules, and wherein an amount of heavy hydrocarbon molecules in the treated hydrocarbon stream is less than an amount of heavy hydrocarbon molecules in the hydrocarbon stream due to hydrocracking of at least a portion of heavy hydrocarbon molecules from the hydrocarbon stream during the step (b) of contacting; wherein the treated hydrocarbon stream comprises $C_9$+ aromatic hydrocarbons, wherein an amount of $C_9$+ aromatic hydrocarbons in the treated hydrocarbon stream is less than an amount of $C_9$+ aromatic hydrocarbons in the hydrocarbon stream due to hydrodealkylating and/or hydrocracking of at least a portion of $C_9$+ aromatic hydrocarbons from the hydrocarbon stream during the step (b) of contacting; and wherein an amount of $C_{6-8}$ aromatic hydrocarbons in the treated hydrocarbon stream is greater than an amount of $C_{6-8}$ aromatic hydrocarbons in the hydrocarbon stream due to hydrodealkylating of at least a portion of $C_9$+ aromatic hydrocarbons and/or hydrocracking of at least a portion of heavy hydrocarbon molecules from the hydrocarbon stream during the step (b) of contacting; and (d) feeding at least a portion of the treated hydrocarbon stream to a steam cracker to yield a high value product, wherein the treated hydrocarbon stream meets steam cracker feed requirements for chloride content, olefin content, boiling end point and sulphur content, and wherein the high value product comprises ethylene, propylene, butene, butadiene, aromatic compounds, or combinations thereof. The plastic waste comprises equal to or greater than about 400 ppmw PVC and/or PVDC. The hydroprocessing catalyst is activated in-situ and/or ex-situ for simultaneous dehydrochlorination, hydrocracking and hydrodealkylation by contacting the hydroprocessing catalyst with a stream containing sulphides and chlorides.

Processes for hydroprocessing a hydrocarbon stream as disclosed herein can advantageously display improvements in one or more process characteristics when compared to an otherwise similar process that does not employ simultaneous dehydrochlorination, hydrocracking and hydrodealkylation of the hydrocarbon stream. Processes for hydroprocessing a hydrocarbon stream as disclosed herein can advantageously reduce the total chloride content in pyrolysis oils from percent to ppm levels, while selectively converting $C_9$+ aromatic hydrocarbons to $C_{6-8}$ aromatic hydrocarbons.

Hydrocracking of olefins and heavy hydrocarbon molecules contained in a hydrocarbon stream can advantageously occur using a hydroprocessing catalyst at the conditions disclosed herein, while also hydrodealkylating $C_9$+ aromatic hydrocarbons in the hydrocarbon stream. The olefins are hydrogenated in addition to being hydrocracked. Moreover, chloride compounds contained in the hydrocarbon stream are removed. Simultaneous hydrodealkylation, hydrogenation, dechlorination, and hydrocracking of a hydrocarbon stream components is advantageously achieved in a single hydroprocessing step, with the treated hydrocarbon product being capable of feeding to a steam cracker having the feed requirements specified herein, without further separations or fractionations of the treated hydrocarbon product. Simultaneous hydrodealkylation, hydrogenation, dechlorination, and hydrocracking is advantageously achieved by continuously contacting a hydrocarbon stream having one or more sulphides and one or more chloride compounds in the amounts disclosed herein with the hydroprocessing catalyst in the presence of hydrogen at the operating conditions disclosed herein. That is, catalyst activity can be initiated and/or maintained simultaneously with the simultaneous hydrodealkylation, hydrogenation, dechlorination, and hydrocracking by using hydrocarbon streams of the compositions disclosed herein which feed to a hydroprocessing reactor.

An aromatic separation process to obtain high value aromatics such as $C_{6-8}$ aromatic hydrocarbons can be advantageously simplified owing to a reduced content of higher aromatics such as $C_9$+ aromatic hydrocarbons in the treated hydrocarbon stream.

Hydrocracking as disclosed herein can occur over the operating pressures disclosed herein for hydroprocessing reactor 10, including those low pressures demonstrated in the examples. The processes for hydroprocessing a hydrocarbon stream as disclosed herein meet the boiling end point of 370° C. required for steam crackers. When the hydrocarbon stream contains a plastic pyrolysis oil, the heavier ends of the plastic pyrolysis oil are hydrocracked, while at least a portion of the $C_9$+ aromatic hydrocarbons is hydrodealkylated. Increased levels of paraffins due to the hydrocracking ability of the processes disclosed herein can advantageously result in a higher production of propylene in steam crackers.

Operation at low temperatures (e.g., less than 350° C.) has an added advantage of corrosion mitigation of the reactor metallurgy. For most metals and alloys used in the commercial reactors, corrosion rates start to increase at reactor temperatures over 300° C. It has been found that the efficiency of dechlorination according to the disclosed processes is good at reactor temperatures below 350° C., and the dechlorination process works with a sulphided Co—Mo catalyst on an alumina support even as low as 260° C., with the chlorides in the treated product being less than 1 ppm. Thus, the metallurgy corrosion issue is mitigated and longer equipment life is possible while achieving dechlorination to levels desirable for feeding to steam cracker 30. The processes disclosed herein have been demonstrated to work at pressures as low as 10 barg, which is a less severe condition than the conditions typically employed with a commercial hydrotreating catalyst. Ability to operate at lower pressures reduces the required pressure rating for process vessels (e.g., the hydroprocessing reactor 10) and provides an opportunity for reduced investment costs. The hydrotreating catalyst used in the processes disclosed herein can be obtained and modified at a low cost, as compared to a hydrocracking catalyst, while advantageously providing for simultaneous dehydrochlorination, hydrocracking and hydrodealkylation of the hydrocarbon stream.

The disclosed processes achieve the requirements of chloride content, olefin content, and boiling end point of the feed for a steam cracker, while simultaneously leading to the production of an increased amount of $C_{6-8}$ aromatic hydrocarbons. Additional advantages of the processes for hydroprocessing a hydrocarbon stream as disclosed herein can be apparent to one of skill in the art viewing this disclosure.

EXAMPLES

Example 1

All hydroprocessing experiments were conducted with a Co—Mo oxides on alumina hydrotreating catalyst, and by using the following procedure, unless otherwise specified. The hydrotreating catalyst was activated by sulphiding it with a hexadecane feed spiked with 3 wt. % sulphur from dimethyl disulphide (DMDS). Following complete sulphiding (sulphide activation) of the catalyst, a chloride (205 ppm) and sulphide (2 wt. %) containing PIONA (n-paraffin, i-paraffin, olefin, naphthene, aromatics) feed (30% hexadecane, 10% i-octane, 20% 1-decene, 20% cyclohexane and 20% ethyl benzene) was introduced into the reactor bed at an operating temperature of 260° C.; an operating pressure of 60 barg, a weight hourly space velocity (WHSV) of 0.92 $hr^{-1}$; and 414 NL/L hydrogen to hydrocarbon ratio. The continuous processing of the feed led to not only dechlorination of feed, but also the acidification (chloride activation) of the hydrotreating catalyst, thereby resulting in a catalyst containing hydrogenation (sulphided metal sites) and cracking sites (alumina chloride). Following this optional pretreatment, the catalyst was then contacted with a plastic pyrolysis oil doped with organic chlorides and sulphides. Under different operating conditions covered in the examples below, simultaneous dehydrochlorination, hydrocracking and hydrodealkylation was achieved. Thus it was possible to generate a feed that can be fed to the steam cracker.

Mixed plastic having a composition of 82% polyolefins, 11% polystyrene and 7% polyethylene terephthalate (PET) was converted to a pyrolysis oil in a circulating fluidized bed riser reactor employing a spent fluid catalytic cracking catalyst containing USY Zeolite. The cup mix zone temperature of the feed and the catalyst at the bottom of the riser reactor was 535° C. (downstream of the feed and catalyst introduction position). The gas yield was 58.8 wt. %, liquid yield was 32.9 wt. %, and coke yield was 8.4 wt. %. The yield of gasoline (<220° C.) was 29.3 wt. % and the balance liquid was in diesel and heavy ends. 36 g of this liquid product was mixed with 240 g of n-hexadecane to prepare a feed mixture (e.g., hydrocarbon stream). This resultant mixture was used in subsequent experiments in fixed bed reactors as a feed, as detailed in examples below. The composition of the feed mixture was investigated with Detailed Hydrocarbon Analyser (ASTM D6730) and Simulated Distillation (SIMDIS) gas chromatographs from M/S AC Analyticals BV, The Netherlands. A detailed hydrocarbon analysis (DHA) of liquid boiling below 240° C. of the feed mixture is displayed in Table 1, and the boiling point distribution of this feed is displayed in Table 2. From data in Table 1, it can be seen that on a heavies and unknown-free basis, the PIONA or P/I/O/N/A composition of the feed cut boiling below 240° C. is 3.77 wt. % P/7.83 wt. % I/0.55 wt. % O/0.14 wt. % N/87.71 wt. % A, the $C_9$+ aromatics in the feed on a heavies and unknown-free basis is 66.34 wt. %, and the $C_6$-$C_8$ aromatics in the feed on a heavies and unknown-free basis is 21.37 wt. %.

TABLE 1

| Carbon# | n-paraffins | i-paraffins | olefins | Naphthenes | Aromatics | Total |
|---|---|---|---|---|---|---|
| C2 | 0 | | | | | 0 |
| C3 | | | | | | |
| C4 | | | | | | 0 |
| C5 | 0 | 0.067 | 0.143 | 0 | | 0.21 |
| C6 | 0.078 | 0.273 | 0.206 | 0.059 | 0.093 | 0.709 |
| C7 | 0.129 | 0.487 | 0.095 | 0 | 2.27 | 2.981 |
| C8 | 0 | 0.539 | 0 | 0 | 14.9 | 15.439 |
| C9 | 0.518 | 0.72 | 0 | 0 | 29.07 | 30.308 |
| C10 | 0.752 | 1.062 | 0 | 0 | 11.039 | 12.853 |
| C11 | 0.693 | 2.911 | 0 | 0 | 4.419 | 8.023 |
| C12 | 0.527 | 0.264 | 0 | 0.052 | 9.05 | 9.893 |
| C13 | 0.351 | 0 | 0 | 0 | 0 | 0.351 |
| Total | 3.048 | 6.323 | 0.444 | 0.111 | 70.841 | 80.767 |
| | | | | | Total oxygenates | 0 |
| | | | | | Total Heavies | 16.372 |
| | | | | | Total unknowns | 2.859 |
| | | | | | Grand Total | 99.998 |

TABLE 2

| Mass % | Degree C. |
|---|---|
| IBP | 132 |
| 5 | 174.4 |
| 10 | 243.6 |
| 15 | 285.2 |
| 20 | 287.4 |
| 25 | 289 |
| 30 | 290.2 |
| 35 | 291.4 |
| 40 | 292.2 |
| 45 | 293.2 |
| 50 | 294 |
| 55 | 294.8 |
| 60 | 295.4 |
| 65 | 296 |
| 70 | 296.6 |
| 75 | 297.2 |

TABLE 2-continued

| Mass % | Degree C. |
|---|---|
| 80 | 297.6 |
| 85 | 298.2 |
| 90 | 298.8 |
| 95 | 299.2 |
| 99 | 328.8 |
| FBP | 380.2 |

IBP = initial boiling point;
FBP = final boiling point.

The results in Table 2 indicate that about 9.73 wt. % of the feed boils below 240° C. and 14.4 wt. % of the feed boils below 280° C. On a heavies and unknown-free basis, the wt. % of various species in feed boiling below 240° C. is as displayed in Table 3.

TABLE 3

| Carbon# | n-paraffins | i-paraffins | Olefins | naphthenes | Aromatics | total |
|---|---|---|---|---|---|---|
| C2 | 0.000 | 0.000 | 0.000 | 0.000 | 0.000 | 0.000 |
| C3 | 0.000 | 0.000 | 0.000 | 0.000 | 0.000 | |
| C4 | 0.000 | 0.000 | 0.000 | 0.000 | 0.000 | 0.000 |
| C5 | 0.000 | 0.008 | 0.017 | 0.000 | 0.000 | 0.025 |
| C6 | 0.009 | 0.033 | 0.025 | 0.007 | 0.011 | 0.085 |
| C7 | 0.016 | 0.059 | 0.011 | 0.000 | 0.274 | 0.359 |
| C8 | 0.000 | 0.065 | 0.000 | 0.000 | 1.797 | 1.862 |
| C9 | 0.062 | 0.087 | 0.000 | 0.000 | 3.506 | 3.655 |
| C10 | 0.091 | 0.128 | 0.000 | 0.000 | 1.331 | 1.550 |
| C11 | 0.084 | 0.351 | 0.000 | 0.000 | 0.533 | 0.968 |
| C12 | 0.064 | 0.032 | 0.000 | 0.006 | 1.091 | 1.193 |
| C13 | 0.042 | 0.000 | 0.000 | 0.000 | 0.000 | 0.042 |
| Total | 0.368 | 0.763 | 0.054 | 0.013 | 8.543 | 9.740 |

Organic chlorides and DMDS were mixed with this feed to give a chloride content of 836 ppmw chloride, based on the total weight of the feed and a sulphur content of the feed of 2.34 wt. % sulphur, based on the total weight of the feed. The above data in Table 3 indicate the P/I/O/N/A boiling below 240° C. in the entire feed. These data were used for comparing with a similar composition product data from subsequent examples to determine depletion and/or formation of different compounds. Table 2 presents the boiling point distribution of the entire feed and was used to compare with the boiling point distribution of the products in subsequent examples to determine the % of lighter molecules formed by hydrocracking.

Example 2

A hydroprocessing experiment was conducted as described in Example 1, wherein n-hexadecane doped with 1,034 ppmw organic chlorides and 2 wt. % S was used in the trials with the fixed bed catalyst system. The experiment was conducted at a reactor catalyst bed temperature of 300° C. and a pressure of 40 barg, at a WHSV of 0.92 $hr^{-1}$, and at a hydrogen to hydrocarbon ratio of 414 NL/L. Simulated distillation results for the liquid product are displayed in Table 4.

TABLE 4

| Mass % | Deg C. |
|---|---|
| IBP | 61.4 |
| 5 | 129.4 |
| 10 | 161.2 |
| 15 | 272.4 |
| 20 | 285.2 |
| 25 | 287.4 |
| 30 | 289 |
| 35 | 290.2 |
| 40 | 291.2 |

TABLE 4-continued

| Mass % | Deg C. |
|---|---|
| 45 | 292.2 |
| 50 | 293 |
| 55 | 293.8 |
| 60 | 294.4 |
| 65 | 295 |
| 70 | 295.6 |
| 75 | 296.2 |
| 80 | 297 |
| 85 | 297.4 |
| 90 | 297.8 |
| 95 | 298.2 |
| 99 | 298.8 |
| FBP | 310.8 |

The results in Table 4 indicate that 13.5 wt. % of the product boils below 240° C. and 18 wt. % of the product boils below 280° C. The overall boiling points correspond to the use and conversion of the n-hexadecane feed. The liquid product had 0.3 ppmw chloride content. The DHA results for the liquid product boiling below 240° C. are displayed in Table 5.

TABLE 5

| Carbon# | n-paraffins | i-paraffins | olefins | Naphthenes | Aromatics | Total |
|---|---|---|---|---|---|---|
| C2 | 0.005 | | | | | 0.005 |
| C3 | 0.006 | | | | | |
| C4 | 0.019 | 0.098 | | | | 0.117 |
| C5 | 0.068 | 0.064 | | 0 | | 0.132 |
| C6 | 0.072 | 0.133 | | 25.607 | 0.11 | 25.922 |
| C7 | 0.016 | 0.034 | | 0 | 0 | 0.05 |
| C8 | 0.401 | 13.31 | | 1.268 | 21.179 | 36.158 |
| C9 | 0 | 0.133 | 0.136 | 5.53 | 2.449 | 8.248 |
| C10 | 19.165 | 8.19 | | 0.213 | 0.049 | 27.617 |
| C11 | 0.03 | 0 | | 0 | 0 | 0.03 |
| C12 | 0.011 | 0 | | 0 | 0 | 0.011 |
| C13 | 0 | 0 | | 0 | 0 | 0 |
| | 19.793 | 21.962 | 0.136 | 32.618 | 23.787 | 98.29 |
| | | | | | Total oxygenates | 0 |
| | | | | | Total Heavies | 1.413 |
| | | | | | Total unknowns | 0.29 |
| | | | | | Grand Total | 99.993 |

The data in Table 5 indicate that an amount of $C_{6-8}$ aromatic hydrocarbons in a product stream (e.g., hydrocarbon product stream 2, treated hydrocarbon stream 4, etc. in FIG. 1) is increased when compared to an amount of $C_{6-8}$ aromatic hydrocarbons in a feed stream (e.g., hydrocarbon stream 1 in the FIGURE), wherein the increase in the amount of $C_{6-8}$ aromatic hydrocarbons is due to hydrocracking of saturated compounds. For example, hexadecane, which is a n-paraffin, converts to form a significant amount of aromatics.

The data in Table 5 were normalized on a heavies and unknown-free basis, and the wt. % concentration of various species in the liquid product boiling below 240° C. is displayed in Table 6.

TABLE 6

| Carbon# | n-paraffins | i-paraffins | Olefins | Naphthenes | Aromatics | Total |
|---|---|---|---|---|---|---|
| C2 | 0.005 | 0.000 | 0.000 | 0.000 | 0.000 | 0.005 |
| C3 | 0.006 | 0.000 | 0.000 | 0.000 | 0.000 | |
| C4 | 0.019 | 0.100 | 0.000 | 0.000 | 0.000 | 0.119 |
| C5 | 0.069 | 0.065 | 0.000 | 0.000 | 0.000 | 0.134 |
| C6 | 0.073 | 0.135 | 0.000 | 26.052 | 0.112 | 26.373 |
| C7 | 0.016 | 0.035 | 0.000 | 0.000 | 0.000 | 0.051 |
| C8 | 0.408 | 13.542 | 0.000 | 1.290 | 21.547 | 36.783 |
| C9 | 0.000 | 0.135 | 0.138 | 5.626 | 2.492 | 8.391 |
| C10 | 19.498 | 8.332 | 0.000 | 0.217 | 0.050 | 28.093 |
| C11 | 0.031 | 0.000 | 0.000 | 0.000 | 0.000 | 0.031 |
| C12 | 0.011 | 0.000 | 0.000 | 0.000 | 0.000 | 0.011 |
| C13 | 0.000 | 0.000 | 0.000 | 0.000 | 0.000 | 0.000 |
| Total | 20.137 | 22.344 | 0.138 | 33.185 | 24.201 | 100.000 |

By accounting for 13.5 wt. % of n-hexadecane being converted to species boiling below 240° C., the yields of these species in wt. % of n-hexadecane feed were calculated and are displayed in Table 7.

TABLE 7

| Carbon# | n-paraffins | i-paraffins | Olefins | naphthenes | Aromatics | Total |
|---|---|---|---|---|---|---|
| C2 | 0.001 | 0.000 | 0.000 | 0.000 | 0.000 | 0.001 |
| C3 | 0.001 | 0.000 | 0.000 | 0.000 | 0.000 | |
| C4 | 0.003 | 0.014 | 0.000 | 0.000 | 0.000 | 0.016 |
| C5 | 0.009 | 0.009 | 0.000 | 0.000 | 0.000 | 0.018 |
| C6 | 0.010 | 0.018 | 0.000 | 3.528 | 0.015 | 3.572 |
| C7 | 0.002 | 0.005 | 0.000 | 0.000 | 0.000 | 0.007 |
| C8 | 0.055 | 1.834 | 0.000 | 0.175 | 2.918 | 4.982 |
| C9 | 0.000 | 0.018 | 0.019 | 0.762 | 0.337 | 1.136 |
| C10 | 2.641 | 1.128 | 0.000 | 0.029 | 0.007 | 3.805 |
| C11 | 0.004 | 0.000 | 0.000 | 0.000 | 0.000 | 0.004 |
| C12 | 0.002 | 0.000 | 0.000 | 0.000 | 0.000 | 0.002 |
| C13 | 0.000 | 0.000 | 0.000 | 0.000 | 0.000 | 0.000 |
| Total | 2.727 | 3.026 | 0.019 | 4.494 | 3.278 | 13.543 |

The data in Table 7 indicate that n-hexadecane was predominantly converted to n-paraffins, i-paraffins, naphthenes and aromatics. Hence, from these data it is shown that $C_6$-$C_8$, as well as $C_9$ aromatics can be formed during hydrocracking of heavy hydrocarbon molecules.

Example 3

Additional studies were also carried out as described in Example 1, wherein the experimental conditions are displayed in Table 8, and wherein data were calculated as described in Example 2.

TABLE 8

| | T, deg C. | P, barg | WHSV, $hr^{-1}$ | $H_2$/HC, NL/L |
|---|---|---|---|---|
| Example 3 | 300 | 60 | 0.92 | 4.14 |
| Example 4 | 300 | 40 | 0.92 | 4.14 |
| Example 5 | 350 | 40 | 0.92 | 4.14 |
| Example 6 | 400 | 40 | 0.92 | 4.14 |

The DHA results for the liquid product boiling below 240° C. are displayed in Table 9.

TABLE 9

| Carbon# | n-paraffins | i-paraffins | Olefins | naphthenes | Aromatics | total |
|---|---|---|---|---|---|---|
| C2 | | | | | | 0 |
| C3 | | | | | | |
| C4 | 0 | 0.045 | | 0 | | 0.045 |
| C5 | 0.177 | 0.166 | | 0 | | 0.343 |
| C6 | 0.319 | 0.557 | | 22.115 | 0.182 | 23.173 |
| C7 | 0 | 0.133 | 11.716 | 0 | 0 | 11.849 |
| C8 | 1.31 | 0 | | 4.402 | 9.039 | 14.751 |
| C9 | 0 | 0 | | 12.96 | 2.984 | 15.944 |
| C10 | 15.619 | 10.446 | | 0.388 | 0 | 26.453 |
| C11 | 0 | 0 | | 0 | 0 | 0 |

TABLE 9-continued

| Carbon# | n-paraffins | i-paraffins | Olefins | naphthenes | Aromatics | total |
|---|---|---|---|---|---|---|
| C12 | 0 | 0 | | 0 | 0 | 0 |
| C13 | 0 | 0 | | 0 | 0 | 0 |
| Total | 17.425 | 11.347 | 11.716 | 39.865 | 12.205 | 92.558 |
| | | | | | Total oxygenates | 0 |
| | | | | | Total Heavies | 6.992 |
| | | | | | Total unknowns | 0.45 |

On a heavies and unknown-free basis, the DHA analysis results are displayed in Table 10. As compared to the feed aromatics content of 87.7 wt. %, there is a significant drop in product aromatics to 13.19 wt. %, on a heavies and unknown-free basis, indicating that ring opening hydrocracking is more favored at high pressures.

TABLE 10

| Carbon# | n-paraffins | i-paraffins | Olefins | Naphthenes | Aromatics | Total |
|---|---|---|---|---|---|---|
| C2 | | | | | | 0 |
| C3 | | | | | | |
| C4 | 0.000 | 0.049 | 0.000 | 0.000 | 0.000 | 0.049 |
| C5 | 0.191 | 0.179 | 0.000 | 0.000 | 0.000 | 0.371 |
| C6 | 0.345 | 0.602 | 0.000 | 23.893 | 0.197 | 25.036 |
| C7 | 0.000 | 0.144 | 12.658 | 0.000 | 0.000 | 12.802 |
| C8 | 1.415 | 0.000 | 0.000 | 4.756 | 9.766 | 15.937 |
| C9 | 0.000 | 0.000 | 0.000 | 14.002 | 3.224 | 17.226 |
| C10 | 16.875 | 11.286 | 0.000 | 0.419 | 0.000 | 28.580 |
| C11 | 0.000 | 0.000 | 0.000 | 0.000 | 0.000 | 0.000 |
| C12 | 0.000 | 0.000 | 0.000 | 0.000 | 0.000 | 0.000 |
| C13 | 0.000 | 0.000 | 0.000 | 0.000 | 0.000 | 0.000 |
| Total | 18.826 | 12.259 | 12.658 | 43.070 | 13.186 | 100.000 |

The boiling point distribution of the liquid product is displayed in Table 11.

TABLE 11

| Mass % | Deg C. |
|---|---|
| IBP | 72 |
| 5 | 87.6 |
| 10 | 160.2 |
| 15 | 280.4 |
| 20 | 284.8 |
| 25 | 286.4 |
| 30 | 287.4 |
| 35 | 288.6 |
| 40 | 289.4 |
| 45 | 290.2 |
| 50 | 290.8 |
| 55 | 291.4 |
| 60 | 292 |

TABLE 11-continued

| Mass % | Deg C. |
|---|---|
| 65 | 292.4 |
| 70 | 292.8 |
| 75 | 293.6 |
| 80 | 293.8 |
| 85 | 294.2 |
| 90 | 294.8 |
| 95 | 295.2 |
| 99 | 295.6 |
| FBP | 295.6 |

The results in Table 11 indicate that 13.3 wt. % of the product boils below 240° C. and 15 wt. % of the product boils below 280° C. By accounting for 13.3 wt. % of liquid product boiling below 240° C., the corresponding yields of the species in wt. % of feed were calculated and are displayed in Table 12.

TABLE 12

| Carbon# | n-paraffins | i-paraffins | Olefins | naphthenes | Aromatics | Total |
|---|---|---|---|---|---|---|
| C2 | 0.000 | 0.000 | 0.000 | 0.000 | 0.000 | 0.000 |
| C3 | 0.000 | 0.000 | 0.000 | 0.000 | 0.000 | 0.000 |
| C4 | 0.000 | 0.006 | 0.000 | 0.000 | 0.000 | 0.006 |
| C5 | 0.025 | 0.024 | 0.000 | 0.000 | 0.000 | 0.049 |
| C6 | 0.046 | 0.080 | 0.000 | 3.182 | 0.026 | 3.335 |
| C7 | 0.000 | 0.019 | 1.686 | 0.000 | 0.000 | 1.705 |
| C8 | 0.189 | 0.000 | 0.000 | 0.633 | 1.301 | 2.123 |
| C9 | 0.000 | 0.000 | 0.000 | 1.865 | 0.429 | 2.294 |
| C10 | 2.248 | 1.503 | 0.000 | 0.056 | 0.000 | 3.807 |

TABLE 12-continued

| Carbon# | n-paraffins | i-paraffins | Olefins | naphthenes | Aromatics | Total |
|---|---|---|---|---|---|---|
| C11 | 0.000 | 0.000 | 0.000 | 0.000 | 0.000 | 0.000 |
| C12 | 0.000 | 0.000 | 0.000 | 0.000 | 0.000 | 0.000 |
| C13 | 0.000 | 0.000 | 0.000 | 0.000 | 0.000 | 0.000 |
| Total | 2.508 | 1.633 | 1.686 | 5.737 | 1.756 | 13.319 |

Further, by subtracting the yields in Table 12 from the feed wt. % composition outlined in Example 1, yields for newly or freshly formed species were obtained and are displayed in Table 13.

TABLE 13

| Carbon# | n-paraffins | i-paraffins | Olefins | Naphthenes | Aromatics | Total |
|---|---|---|---|---|---|---|
| C2 | 0.000 | 0.000 | 0.000 | 0.000 | 0.000 | 0.000 |
| C3 | 0.000 | 0.000 | 0.000 | 0.000 | 0.000 | 0.000 |
| C4 | 0.000 | 0.006 | 0.000 | 0.000 | 0.000 | 0.006 |
| C5 | 0.025 | 0.016 | −0.017 | 0.000 | 0.000 | 0.024 |
| C6 | 0.036 | 0.047 | −0.025 | 3.175 | 0.015 | 3.249 |
| C7 | −0.016 | −0.040 | 1.675 | 0.000 | −0.274 | 1.346 |
| C8 | 0.189 | −0.065 | 0.000 | 0.633 | −0.496 | 0.261 |
| C9 | −0.062 | −0.087 | 0.000 | 1.865 | −3.076 | −1.361 |
| C10 | 2.157 | 1.375 | 0.000 | 0.056 | −1.331 | 2.257 |
| C11 | −0.084 | −0.351 | 0.000 | 0.000 | −0.533 | −0.968 |
| C12 | −0.064 | −0.032 | 0.000 | −0.006 | −1.091 | −1.193 |
| C13 | −0.042 | 0.000 | 0.000 | 0.000 | 0.000 | −0.042 |
| Total | 2.140 | 0.870 | 1.632 | 5.723 | −6.787 | 3.580 |

The data in Table 13 clearly indicate that the alkyl aromatics in feed convert to other paraffin, naphthene and olefin compounds. At the relatively high pressure of 60 barg employed in this experiment, except for $C_6$ aromatics, all other aromatics were also getting converted. Hence, if it would be preferred to ring open all or almost all aromatics, high pressure conditions could facilitate such ring opening.

Example 4

Additional studies were also carried out as described in Examples 1 and 3, wherein the experimental conditions were as outlined in Table 8 for Example 4, and wherein data were calculated as described in Examples 2 and 3. The DHA results for the liquid product boiling below 240° C. are displayed in Table 14.

TABLE 14

| Carbon# | n-paraffins | i-paraffins | olefins | Naphthenes | Aromatics | Total |
|---|---|---|---|---|---|---|
| C3 | | | | | | |
| C4 | 0.037 | 0.035 | | | | 0.072 |
| C5 | 0.139 | 0.282 | | 0 | | 0.421 |
| C6 | 1.278 | 0.893 | | 8.257 | 0.131 | 10.559 |
| C7 | 0.161 | 0.637 | 4.408 | 0.649 | 1.397 | 7.252 |
| C8 | 1.333 | 0.304 | 0.283 | 2.241 | 17.316 | 21.477 |
| C9 | 0.259 | 1.158 | 0.178 | 4.124 | 13.44 | 19.159 |
| C10 | 11.524 | 6.056 | 0 | 0 | 5.012 | 22.592 |
| C11 | 0.461 | 1.642 | 0 | 0 | 0.887 | 2.99 |
| C12 | 0.334 | 0.145 | 0 | 0.574 | 0.835 | 1.888 |
| C13 | 0.2 | 0 | 0.095 | 0 | 0 | 0.295 |
| Total | 15.726 | 11.152 | 4.964 | 15.845 | 39.018 | 86.705 |
| | | | | | Total oxygenates | 0 |
| | | | | | Total Heavies | 8.171 |
| | | | | | Total unknowns | 5.124 |
| | | | | | Grand Total | 100 |

On a heavies and unknown-free basis, the DHA analysis results are displayed in Table 15. The $C_9$+ aromatics were 66.3 wt. % in the feed and dropped down to 23.27 wt. % in the product, indicating significant dealkylation of $C_9$+ aromatics. The $C_6$-$C_8$ aromatics in products were 21.73 wt. %, a slight change from 21.37 wt. % in the feed.

TABLE 15

| Carbon# | n-paraffins | i-paraffins | olefins | Naphthenes | Aromatics | Total |
|---|---|---|---|---|---|---|
| C3 | | | | | | |
| C4 | 0.043 | 0.040 | 0.000 | 0.000 | 0.000 | 0.083 |
| C5 | 0.160 | 0.325 | 0.000 | 0.000 | 0.000 | 0.486 |
| C6 | 1.474 | 1.030 | 0.000 | 9.523 | 0.151 | 12.178 |
| C7 | 0.186 | 0.735 | 5.084 | 0.749 | 1.611 | 8.364 |
| C8 | 1.537 | 0.351 | 0.326 | 2.585 | 19.971 | 24.770 |
| C9 | 0.299 | 1.336 | 0.205 | 4.756 | 15.501 | 22.097 |
| C10 | 13.291 | 6.985 | 0.000 | 0.000 | 5.781 | 26.056 |
| C11 | 0.532 | 1.894 | 0.000 | 0.000 | 1.023 | 3.448 |
| C12 | 0.385 | 0.167 | 0.000 | 0.662 | 0.963 | 2.177 |
| C13 | 0.231 | 0.000 | 0.110 | 0.000 | 0.000 | 0.340 |
| Total | 18.137 | 12.862 | 5.725 | 18.275 | 45.001 | 100.000 |

The boiling point distribution of the liquid product is displayed in Table 16.

TABLE 16

| Mass % | Deg C. |
|---|---|
| IBP | 72 |
| 5 | 134.6 |
| 10 | 180.6 |
| 15 | 277.8 |
| 20 | 285 |
| 25 | 286.8 |
| 30 | 288 |
| 35 | 289 |
| 40 | 290 |
| 45 | 290.8 |
| 50 | 291.4 |
| 55 | 292.2 |
| 60 | 292.8 |

TABLE 16-continued

| Mass % | Deg C. |
|---|---|
| 65 | 293.4 |
| 70 | 293.8 |
| 75 | 294.4 |
| 80 | 294.8 |
| 85 | 295.4 |
| 90 | 295.8 |
| 95 | 296.2 |
| 99 | 296.6 |
| FBP | 296.6 |

The results in Table 16 indicate that 13.1 wt. % of the product boils below 240° C. and 16.5 wt. % of the product boils below 280° C. By accounting for 13.1 wt. % of liquid product boiling below 240° C., the corresponding yields of the species in wt. % of feed were calculated and are displayed in Table 17.

TABLE 17

| Carbon# | n-paraffins | i-paraffins | olefins | Naphthenes | Aromatics | Total |
|---|---|---|---|---|---|---|
| C3 | | | | | | |
| C4 | 0.006 | 0.005 | 0.000 | 0.000 | 0.000 | 0.011 |
| C5 | 0.021 | 0.042 | 0.000 | 0.000 | 0.000 | 0.063 |
| C6 | 0.192 | 0.134 | 0.000 | 1.243 | 0.020 | 1.590 |
| C7 | 0.024 | 0.096 | 0.664 | 0.098 | 0.210 | 1.092 |
| C8 | 0.201 | 0.046 | 0.043 | 0.337 | 2.607 | 3.234 |
| C9 | 0.039 | 0.174 | 0.027 | 0.621 | 2.024 | 2.885 |
| C10 | 1.735 | 0.912 | 0.000 | 0.000 | 0.755 | 3.402 |
| C11 | 0.069 | 0.247 | 0.000 | 0.000 | 0.134 | 0.450 |
| C12 | 0.050 | 0.022 | 0.000 | 0.086 | 0.126 | 0.284 |
| C13 | 0.030 | 0.000 | 0.014 | 0.000 | 0.000 | 0.044 |
| Total | 2.368 | 1.679 | 0.747 | 2.386 | 5.875 | 13.056 |

Further, by subtracting the yields in Table 17 from the feed wt. % composition outlined in Example 1, yields for newly or freshly formed species were obtained and are displayed in Table 18.

TABLE 18

| Carbon# | n-paraffins | i-paraffins | olefins | Naphthenes | Aromatics | Total |
|---|---|---|---|---|---|---|
| C3 | | | | | | |
| C4 | 0.006 | 0.005 | 0.000 | 0.000 | 0.000 | 0.011 |
| C5 | 0.021 | 0.034 | −0.017 | 0.000 | 0.000 | 0.038 |
| C6 | 0.183 | 0.102 | −0.025 | 1.236 | 0.009 | 1.504 |
| C7 | 0.009 | 0.037 | 0.652 | 0.098 | −0.063 | 0.732 |
| C8 | 0.201 | −0.019 | 0.043 | 0.337 | 0.811 | 1.372 |
| C9 | −0.023 | 0.088 | 0.027 | 0.621 | −1.482 | −0.770 |
| C10 | 1.645 | 0.784 | 0.000 | 0.000 | −0.577 | 1.852 |
| C11 | −0.014 | −0.104 | 0.000 | 0.000 | −0.399 | −0.517 |
| C12 | −0.013 | −0.010 | 0.000 | 0.080 | −0.966 | −0.909 |
| C13 | −0.012 | 0.000 | 0.014 | 0.000 | 0.000 | 0.002 |
| Total | 2.000 | 0.917 | 0.694 | 2.372 | −2.668 | 3.316 |

The data in Table 18 clearly indicate that the alkyl aromatics in the feed convert to other paraffin, naphthene and olefin compounds. Additionally, higher molecular weight compounds in the feed convert to lower molecular weight components. The data in Table 18 clearly indicate a reduction in $C_9$ to $C_{12}$ aromatics. This reduction was 53% as compared to $C_9$+ aromatics in the feed. This % reduction was computed by dividing the difference in $C_9$+ aromatics from Table 18 by $C_9$+ aromatics from Table 3 and expressing the result as a % reduction. In addition, formation of $C_6$-$C_8$ aromatics was 36.4% (e.g., % increase in $C_6$-$C_8$ aromatics) through a similar calculation.

Example 5

Additional studies were carried out as described in Examples 1 and 3, wherein the experimental conditions were as outlined in Table 8, and data were calculated as described in Examples 2 and 3. The DHA results for the liquid product boiling below 240° C. are displayed in Table 19.

TABLE 19

| Carbon# | n-paraffins | i-paraffins | olefins | naphthenes | Aromatics | Total |
|---|---|---|---|---|---|---|
| C3 | | | | | | |
| C4 | 0.112 | 0.057 | | | | 0.169 |
| C5 | 0.364 | 0.426 | | 0.031 | | 0.821 |
| C6 | 1.483 | 1.135 | | 3.629 | 0.105 | 6.352 |
| C7 | 0.511 | 1.096 | 1.892 | 1.701 | 1.329 | 6.529 |
| C8 | 1.898 | 1.151 | 0 | 3.914 | 11.697 | 18.66 |
| C9 | 0.924 | 2.268 | 0.783 | 3.121 | 11.839 | 18.935 |
| C10 | 4.118 | 2.968 | 0.164 | 0.257 | 4.67 | 12.177 |
| C11 | 0.823 | 2.294 | 0.108 | 0 | 0.67 | 3.895 |
| C12 | 0.663 | 0.218 | 0 | 0.606 | 1.161 | 2.648 |
| C13 | 0.384 | 0.201 | 0.11 | 0 | 0 | 0.695 |
| Total | 11.28 | 11.814 | 3.057 | 13.259 | 31.471 | 70.881 |
| | | | | | Total oxygenates | 0 |
| | | | | | Total Heavies | 20.145 |
| | | | | | Total unknowns | 8.974 |
| | | | | | Grand Total | 100 |

A comparison of DHA results presented in Table 1 with data presented in Tables 9, 14 and 19 highlights the compositional changes between a feed stream (e.g., hydrocarbon stream 1 in the FIGURE) and a product stream (e.g., hydrocarbon product stream 2, treated hydrocarbon stream 4, etc. in the FIGURE).

On a heavies and unknown-free basis, the DHA analysis results are displayed in Table 20.

TABLE 20

| Carbon# | n-paraffins | i-paraffins | olefins | naphthenes | Aromatics | Total |
|---|---|---|---|---|---|---|
| C3 | | | | | | |
| C4 | 0.158 | 0.080 | 0.000 | 0.000 | 0.000 | 0.238 |
| C5 | 0.514 | 0.601 | 0.000 | 0.044 | 0.000 | 1.158 |
| C6 | 2.092 | 1.601 | 0.000 | 5.120 | 0.148 | 8.961 |
| C7 | 0.721 | 1.546 | 2.669 | 2.400 | 1.875 | 9.211 |
| C8 | 2.678 | 1.624 | 0.000 | 5.522 | 16.502 | 26.326 |
| C9 | 1.304 | 3.200 | 1.105 | 4.403 | 16.703 | 26.714 |
| C10 | 5.810 | 4.187 | 0.231 | 0.363 | 6.589 | 17.179 |
| C11 | 1.161 | 3.236 | 0.152 | 0.000 | 0.945 | 5.495 |
| C12 | 0.935 | 0.308 | 0.000 | 0.855 | 1.638 | 3.736 |
| C13 | 0.542 | 0.284 | 0.155 | 0.000 | 0.000 | 0.981 |
| Total | 15.914 | 16.667 | 4.313 | 18.706 | 44.400 | 100.000 |

The data in Tables 15 and 20 display a significant drop in aromatic content in a product stream (e.g., hydrocarbon product stream 2, treated hydrocarbon stream 4, etc. in the FIGURE) as compared to a feed stream (e.g., hydrocarbon stream 1 in the FIGURE).

The boiling point distribution of the liquid product is displayed in Table 21.

TABLE 21

| Mass % | Deg C. |
|---|---|
| IBP | 72 |
| 5 | 137.2 |
| 10 | 183.6 |
| 15 | 261.2 |
| 20 | 272.2 |
| 25 | 277.6 |
| 30 | 281.4 |
| 35 | 285.6 |
| 40 | 287.4 |
| 45 | 288.8 |

TABLE 21-continued

| Mass % | Deg C. |
|---|---|
| 50 | 290 |
| 55 | 290.8 |
| 60 | 291.6 |
| 65 | 292.4 |
| 70 | 293.2 |
| 75 | 293.8 |
| 80 | 294.4 |
| 85 | 295 |
| 90 | 295.6 |
| 95 | 296.2 |
| 99 | 296.4 |
| FBP | 296.4 |

The results in Table 21 indicate that 13.5 wt. % of the product boils below 240° C. and 28.2 wt. % of the product boils below 280° C. By accounting for 13.5 wt. % of liquid product boiling below 240° C., the corresponding yields in wt. % of feed were calculated and are displayed in Table 22.

TABLE 22

| Carbon# | n-paraffins | i-paraffins | Olefins | naphthenes | Aromatics | Total |
|---|---|---|---|---|---|---|
| C3 | | | | | | |
| C4 | 0.021 | 0.011 | 0.000 | 0.000 | 0.000 | 0.032 |
| C5 | 0.069 | 0.081 | 0.000 | 0.006 | 0.000 | 0.156 |
| C6 | 0.282 | 0.216 | 0.000 | 0.691 | 0.020 | 1.210 |
| C7 | 0.097 | 0.209 | 0.360 | 0.324 | 0.253 | 1.243 |
| C8 | 0.361 | 0.219 | 0.000 | 0.745 | 2.228 | 3.554 |
| C9 | 0.176 | 0.432 | 0.149 | 0.594 | 2.255 | 3.606 |
| C10 | 0.784 | 0.565 | 0.031 | 0.049 | 0.889 | 2.319 |
| C11 | 0.157 | 0.437 | 0.021 | 0.000 | 0.128 | 0.742 |
| C12 | 0.126 | 0.042 | 0.000 | 0.115 | 0.221 | 0.504 |
| C13 | 0.073 | 0.038 | 0.021 | 0.000 | 0.000 | 0.132 |
| Total | 2.148 | 2.250 | 0.582 | 2.525 | 5.993 | 13.499 |

Further, by subtracting the yields in Table 22 from the feed wt. % composition outlined in Example 1, yields for newly or freshly formed species were obtained and are displayed in Table 23.

TABLE 23

| Carbon# | n-paraffins | i-paraffins | Olefins | naphthenes | aromatics | total |
|---|---|---|---|---|---|---|
| C3 | | | | | | |
| C4 | 0.021 | 0.011 | 0.000 | 0.000 | 0.000 | 0.032 |
| C5 | 0.069 | 0.073 | −0.017 | 0.006 | 0.000 | 0.131 |
| C6 | 0.273 | 0.183 | −0.025 | 0.684 | 0.009 | 1.124 |
| C7 | 0.082 | 0.150 | 0.349 | 0.324 | −0.021 | 0.884 |
| C8 | 0.361 | 0.154 | 0.000 | 0.745 | 0.431 | 1.692 |
| C9 | 0.114 | 0.345 | 0.149 | 0.594 | −1.251 | −0.049 |
| C10 | 0.694 | 0.437 | 0.031 | 0.049 | −0.442 | 0.769 |
| C11 | 0.073 | 0.086 | 0.021 | 0.000 | −0.405 | −0.226 |
| C12 | 0.063 | 0.010 | 0.000 | 0.109 | −0.870 | −0.689 |
| C13 | 0.031 | 0.038 | 0.021 | 0.000 | 0.000 | 0.090 |
| Total | 1.781 | 1.487 | 0.529 | 2.512 | −2.549 | 3.759 |

The data in Table 23 clearly indicate that the alkyl aromatics in feed convert to other paraffin, naphthene and olefin compounds. Additionally, higher molecular weight compounds in the feed convert to lower molecular weight components. The data in Table 23 clearly indicate (i) a reduction in $C_9$ to $C_{12}$ aromatics: 45.9% reduction of $C_9$+ aromatics using similar calculations as outlined in Example 4; and (ii) a formation of or increase in $C_6$-$C_8$ aromatics: 20.12% increase using similar calculations as outlined in Example 4.

Example 6

Additional studies were also carried out as described in Examples 1 and 3, wherein the experimental conditions were as outlined in Table 8, and wherein data were calculated as described in Examples 2 and 3. The boiling point distribution of the liquid product is displayed in Table 24.

TABLE 24

| Mass % | Deg C. |
|---|---|
| IBP | 36 |
| 5 | 114.2 |
| 10 | 154.8 |
| 15 | 181.2 |
| 20 | 227.2 |
| 25 | 263 |
| 30 | 268.8 |
| 35 | 272.4 |
| 40 | 276 |
| 45 | 278 |
| 50 | 279.8 |
| 55 | 283.4 |
| 60 | 285.6 |
| 65 | 286.8 |
| 70 | 287.6 |
| 75 | 288.4 |
| 80 | 289.2 |
| 85 | 289.8 |
| 90 | 290.2 |
| 95 | 290.8 |
| 99 | 291.2 |
| FBP | 291.4 |

The results in Table 24 indicate that 21.8 wt. % of the product boils below 240° C. and 50.3 wt. % of the product boils below 280° C.

Overall, a summary of the results from Examples 3 to 6 is displayed in Table 25.

TABLE 25

| Liquid Product | Feed | Example 3 | Example 4 | Example 5 | Example 6 |
|---|---|---|---|---|---|
| <240° C., Wt. % | 9.7 | 13.3 | 13.1 | 13.5 | 21.8 |
| <280° C., Wt. % | 14.4 | 15.0 | 16.5 | 28.2 | 50.3 |
| Cl in overall product, ppmw | 836 | 0.32 | 0.87 | 3.42 | 3.15 |

The data in Examples 3 to 6 indicate that at higher temperatures of operation, the conversions to below 240° C. boiling product, as well as below 280° C. boiling product increases. Further, at lower pressures and higher temperatures, $C_9$-$C_{12}$ aromatics yields are reduced while $C_6$-$C_8$ aromatics yields are preserved or improved. Further, at higher pressures, $C_6$-$C_8$ aromatics yields also are reduced. The resulting product can be saturated to a product olefin content to less than 1 wt. % by mild hydrogenation in a downstream hydrogenation unit by applying conventional hydrogenation catalysts, or in the same reactor (e.g., hydroprocessing reactor) by increasing contact time. Overall, the data indicate that higher alkyl aromatics can be dealkylated selectively while preserving $C_6$-$C_8$ aromatics and while having simultaneous dehydrochlorination and hydrocracking.

As will be appreciated by one of skill in the art, and with the help of this disclosure, the product aromatic content depends on the feed aromatic content, as well as on the hydrogen pressure. As can be seen from DHA analysis in Examples 1 to 6, the aromatic content in liquid boiling below 240° C. ranges from 12-40 wt. % in the hydrocarbon product, based on the total weight of the hydrocarbon product boiling below 240° C.; which is down significantly from the ~70 wt. % aromatic content in feed boiling below 240° C., based on the total weight of the feed boiling below 240° C. These data indicate significant ring opening hydrocracking.

Further, the data in Examples 1 to 6 indicate that the $C_9$+ aromatic content in liquid feed boiling below 240° C. of −53.6 wt. %, based on the total weight of the feed boiling below 240° C., drops to a range of 2.98-20.17 wt. % approximately in hydrocarbon product cut boiling below 240° C., based on the total weight of the hydrocarbon product boiling below 240° C. These data indicate significant conversion of $C_{9+}$ aromatics. At higher pressures, lower aromatic content of the hydrocarbon product boiling below 240° C. is observed; and at lower pressures, higher aromatic content of the hydrocarbon product boiling below 240° C. is observed.

ADDITIONAL DISCLOSURE

The following are enumerated embodiments which are provided as non-limiting examples.

A first aspect, which is a process for hydrodealkylating a hydrocarbon stream comprising (a) contacting the hydrocarbon stream with a hydroprocessing catalyst in a hydroprocessing reactor in the presence of hydrogen to yield a hydrocarbon product, wherein the hydrocarbon stream contains $C_9$+ aromatic hydrocarbons; and (b) recovering a treated hydrocarbon stream from the hydrocarbon product, wherein the treated hydrocarbon stream comprises $C_9$+ aromatic hydrocarbons, wherein an amount of $C_9$+ aromatic hydrocarbons in the treated hydrocarbon stream is less than an amount of $C_9$+ aromatic hydrocarbons in the hydrocarbon stream due to hydrodealkylating of at least a portion of $C_9$+ aromatic hydrocarbons from the hydrocarbon stream during the step (a) of contacting.

A second aspect, which is the process of the first aspect, wherein the step (a) of contacting the hydrocarbon stream with a hydroprocessing catalyst is performed at a temperature of from about 100° C. to about 550° C.

A third aspect, which is the process of any one of the first and the second aspects, wherein the step (a) of contacting the hydrocarbon stream with a hydroprocessing catalyst is performed at a pressure of from about 1 bar absolute to about 200 barg.

A fourth aspect, which is the process of any one of the first through the third aspects, wherein the hydroprocessing catalyst is activated in-situ and/or ex-situ by contacting the hydroprocessing catalyst with a stream containing sulphides and chlorides, and wherein the hydroprocessing catalyst is activated for simultaneous dehydrochlorination, hydrocracking and hydrodealkylation.

A fifth aspect, which is the process of any one of the first through the fourth aspects, wherein the step (a) of contacting the hydrocarbon stream with a hydroprocessing catalyst is performed at a weight hourly space velocity of from about 0.1 $hf^{-1}$ to about 10 $hr^{-1}$.

A sixth aspect, which is the process of any one of the first through the fifth aspects, wherein the step (a) of contacting the hydrocarbon stream with a hydroprocessing catalyst is performed at a hydrogen to hydrocarbon ratio of from about 10 NL/L to about 3,000 NL/L.

A seventh aspect, which is the process of any one of the first through the sixth aspects, wherein the hydroprocessing catalyst comprises cobalt and molybdenum on an alumina support, nickel and molybdenum on an alumina support, tungsten and molybdenum on an alumina support, platinum and palladium on an alumina support, nickel sulphides, nickel sulphides on an alumina support, molybdenum sulphides, molybdenum sulphides on an alumina support, nickel and molybdenum sulphides, nickel and molybdenum sulphides on an alumina support, oxides of cobalt and molybdenum, oxides of cobalt and molybdenum on an alumina support, or combinations thereof.

An eighth aspect, which is the process of any one of the first through the seventh aspects, wherein the step (a) of contacting the hydrocarbon stream with a hydroprocessing catalyst further comprises contacting one or more sulphides contained in and/or added to the hydrocarbon stream with the hydroprocessing catalyst.

A ninth aspect, which is the process of the eighth aspect, wherein one or more sulphides are contained in and/or added to the hydrocarbon stream in an amount effective to provide for a sulphur content of the hydrocarbon stream of from about 0.05 wt. % to about 5 wt. %, based on the total weight of the hydrocarbon stream.

A tenth aspect, which is the process of any one of the first through the ninth aspects, wherein one or more chloride compounds are contained in and/or added to the hydrocarbon stream in an amount of equal to or greater than about 10 ppm chloride, based on the total weight of the hydrocarbon stream, and wherein the treated hydrocarbon stream comprises one or more chloride compounds in an amount of less than about 10 ppm chloride, based on the total weight of the treated hydrocarbon stream.

An eleventh aspect, which is the process of any one of the first through the tenth aspects, wherein the hydrocarbon stream further comprises one or more chloride compounds in an amount of equal to or greater than about 200 ppm chloride, based on the total weight of the hydrocarbon stream.

A twelfth aspect, which is the process of any one of the first through the eleventh aspects, wherein the treated hydrocarbon stream further comprises one or more chloride compounds in an amount of less than about 10 ppm, based on the total weight of the treated hydrocarbon stream, the process further comprising feeding the treated hydrocarbon stream to a steam cracker.

A thirteenth aspect, which is the process of the twelfth aspect, wherein the treated hydrocarbon stream is characterized by a boiling end point of less than about 370° C.

A fourteenth aspect, which is the process of any one of the first through the thirteenth aspects, wherein the step (b) of recovering a treated hydrocarbon stream from the hydrocarbon product comprises (i) separating a treated product from a sulphur and chlorine-containing gas in a separator; and (ii) flowing the treated product in the treated hydrocarbon stream from the separator.

A fifteenth aspect, which is the process of any one of the first through the fourteenth aspects, wherein the step (b) of recovering a treated hydrocarbon stream from the hydrocarbon product comprises (i) separating an intermediate treated product from a sulphur and chlorine-containing gas in a separator; (ii) flowing the intermediate treated product in an intermediate treated hydrocarbon stream from the separator to a distillation column to produce a treated hydrocarbon stream characterized by a boiling end point of less than about 370° C. and a heavy treated hydrocarbon stream characterized by a boiling end point of equal to or greater than about 370° C.; (iii) feeding at least a portion of the treated hydrocarbon stream to a steam cracker; and (iv) recycling at least a portion of the heavy treated hydrocarbon stream to the hydroprocessing reactor as hydrocarbon stream.

A sixteenth aspect, which is the process of any one of the first through the fifteenth aspects, wherein the hydrocarbon stream comprises $C_{6-8}$ aromatic hydrocarbons, wherein the treated hydrocarbon stream comprises $C_{6-8}$ aromatic hydrocarbons, and wherein an amount of $C_{6-8}$ aromatic hydrocarbons in the treated hydrocarbon stream is greater than an amount of $C_{6-8}$ aromatic hydrocarbons in the hydrocarbon stream due to hydrodealkylating of at least a portion of $C_9$+ aromatic hydrocarbons from the hydrocarbon stream during step (a).

A seventeenth aspect, which is the process of any one of the first through the sixteenth aspects, wherein the hydrocarbon stream comprises $C_{6-8}$ aromatic hydrocarbons and heavy hydrocarbon molecules, wherein the treated hydrocarbon stream comprises $C_{6-8}$ aromatic hydrocarbons, and wherein an amount of $C_{6-8}$ aromatic hydrocarbons in the treated hydrocarbon stream is increased by equal to or greater than at least 1 wt. % when compared to an amount of $C_{6-8}$ aromatic hydrocarbons in the hydrocarbon stream, and wherein the increase in the amount of $C_{6-8}$ aromatic hydrocarbons is due to hydrodealkylating of at least a portion of $C_9$+ aromatic hydrocarbons and/or hydrocracking of at least a portion of heavy hydrocarbon molecules from the hydrocarbon stream during step (a).

An eighteenth aspect, which is the process of any one of the first through the seventeenth aspects, wherein the at least a portion of $C_9$+ aromatic hydrocarbons which are hydrodealkylated during step (a) is equal to or greater than about 5 wt. % of $C_9$+ aromatic hydrocarbons in the hydrocarbon stream.

An nineteenth aspect, which is the process of any one of the first through the eighteenth aspects, wherein an amount of $C_9$+ aromatic hydrocarbons in the hydrocarbon stream is from about 1 wt. % to about 99 wt. %, based on the total weight of the hydrocarbon stream.

A twentieth aspect, which is the process of any one of the first through the nineteenth aspects, wherein the hydrocarbon stream comprises a plastic pyrolysis oil, a tire pyrolysis oil, a petroleum origin stream, a petroleum refinery stream, pyrolysis gasoline, alkyl aromatic containing streams, or combinations thereof.

A twenty-first aspect, which is a process for hydroprocessing a hydrocarbon stream comprising simultaneous dehydrochlorination, hydrocracking, and hydrodealkylation of the hydrocarbon stream, the process comprising (a) contacting the hydrocarbon stream containing chlorides and sulphides with a hydroprocessing catalyst in the presence of hydrogen to yield a hydrocarbon product; wherein the hydrocarbon stream comprises (i) one or more chloride compounds in an amount of equal to or greater than about 10 ppm chloride, based on the total weight of the hydrocarbon stream; (ii) one or more sulphide compounds in an amount of from about 0.05 wt. % to about 5 wt. % sulfur (S), based on the total weight of the hydrocarbon stream; (iii) $C_5$ to $C_8$ hydrocarbons; (iv) heavy hydrocarbon molecules; and (v) $C_9$+ aromatic hydrocarbons; and (b) recovering a treated hydrocarbon stream from the hydrocarbon product; wherein the treated hydrocarbon stream comprises one or more chloride compounds in an amount of less than about 10 ppm chloride, based on the total weight of the treated hydrocarbon stream, and wherein a decrease in one or more chloride compounds is due to dehydrochlorination of the hydrocarbon stream during the step (a) of contacting; wherein the treated hydrocarbon stream comprises heavy hydrocarbon molecules, and wherein an amount of heavy hydrocarbon molecules in the treated hydrocarbon stream is less than an amount of heavy hydrocarbon molecules in the hydrocarbon stream due to hydrocracking of at least a portion of heavy hydrocarbon molecules from the hydrocarbon stream during the step (a) of contacting; wherein the treated hydrocarbon stream comprises $C_9$+ aromatic hydrocarbons, and wherein an amount of $C_9$+ aromatic hydrocarbons in the treated hydrocarbon stream is less than an amount of $C_9$+ aromatic hydrocarbons in the hydrocarbon stream due to hydrodealkylating of at least a portion of $C_9$+ aromatic hydrocarbons from the hydrocarbon stream during the step (a) of contacting.

A twenty-second aspect, which is the process of the twenty-first aspect, wherein the hydroprocessing catalyst is activated in-situ and/or ex-situ by contacting the hydroprocessing catalyst with a stream containing sulphides and chlorides, and wherein the hydroprocessing catalyst is activated for simultaneous dehydrochlorination, hydrocracking and hydrodealkylation.

A twenty-third aspect, which is a process for processing plastic waste comprising (a) converting a plastic waste to a hydrocarbon stream, wherein the hydrocarbon stream comprises (i) one or more chloride compounds in an amount of equal to or greater than about 10 ppm chloride, based on the total weight of the hydrocarbon stream; (ii) one or more sulphide compounds in an amount of from about 0.05 wt. % to about 5 wt. % sulfur (S), based on the total weight of the hydrocarbon stream; (iii) $C_5$ to $C_8$ hydrocarbons; (iv) heavy hydrocarbon molecules; and (v) $C_9$+ aromatic hydrocarbons; (b) contacting at least a portion of the hydrocarbon stream with a hydroprocessing catalyst in the presence of hydrogen to yield a hydrocarbon product; (c) recovering a treated hydrocarbon stream from the hydrocarbon product; wherein the treated hydrocarbon stream comprises one or more chloride compounds in an amount of less than about 10 ppm chloride, based on the total weight of the treated hydrocarbon stream, and wherein a decrease in one or more chloride compounds is due to dehydrochlorination of the hydrocarbon stream during the step (b) of contacting; wherein the treated hydrocarbon stream comprises heavy hydrocarbon molecules, and wherein an amount of heavy hydrocarbon molecules in the treated hydrocarbon stream is less than an amount of heavy hydrocarbon molecules in the hydrocarbon stream due to hydrocracking of at least a portion of heavy hydrocarbon molecules from the hydrocarbon stream during the step (b) of contacting; wherein the treated hydrocarbon stream comprises $C_9$+ aromatic hydrocarbons, and wherein an amount of $C_9$+ aromatic hydrocarbons in the treated hydrocarbon stream is less than an amount of $C_9$+ aromatic hydrocarbons in the hydrocarbon stream due to hydrodealkylating of at least a portion of $C_9$+ aromatic hydrocarbons from the hydrocarbon stream during the step (b) of contacting; and (d) feeding at least a portion of the treated hydrocarbon stream to a steam cracker to yield a high value product, wherein the treated hydrocarbon stream meets steam cracker feed requirements for chloride content, olefin content, boiling end point and sulphur content, and wherein the high value product comprises ethylene, propylene, butene, butadiene, aromatic compounds, or combinations thereof.

A twenty-fourth aspect, which is the process of the twenty-third aspect, wherein the plastic waste comprises equal to or greater than about 400 ppmw polyvinylchloride and/or polyvinylidene chloride.

A twenty-fifth aspect, which is the process of any one of the twenty-third and the twenty-fourth aspects, wherein the plastic waste contains polyolefins, polystyrenes, polyethylene terephthalate (PET), polyvinylchloride (PVC), polyvinylidene chloride (PVDC), or combinations thereof.

A twenty-sixth aspect, which is the process of any one of the twenty-third through the twenty-fifth aspects, wherein the hydroprocessing catalyst is activated in-situ and/or ex-situ by contacting the hydroprocessing catalyst with a stream containing sulphides and chlorides, and wherein the hydroprocessing catalyst is activated for simultaneous dehydrochlorination, hydrocracking and hydrodealkylation.

What is claimed is:

1. A process for hydrodealkylating a hydrocarbon stream comprising:

(a) contacting the hydrocarbon stream with a hydroprocessing catalyst in a hydroprocessing reactor in the presence of hydrogen to yield a hydrocarbon product, wherein the hydrocarbon stream contains $C_9$ aromatic hydrocarbons; and (b) recovering a treated hydrocarbon stream from the hydrocarbon product, wherein an amount of $C_9$ aromatic hydrocarbons in the treated hydrocarbon stream is less than an amount of $C_9$ aromatic hydrocarbons in the hydrocarbon stream due to hydrodealkylating of at least a portion of $C_9$ aromatic hydrocarbons from the hydrocarbon stream during the step (a) of contacting;

wherein the step (a) of contacting the hydrocarbon stream with a hydroprocessing catalyst is performed at (i) a temperature of 260° C. to 350° C.; (ii) a pressure of 10 barg to 45 barg; (iii) a weight hourly space velocity of about 0.1 $hr^{-1}$ to about 10 $hr^{-1}$; and (iv) a hydrogen to hydrocarbon ratio of 200 NL/L to 800 NL/L;

wherein the hydroprocessing catalyst is activated in-situ and/or ex-situ by contacting the hydroprocessing catalyst with a stream containing sulphides and chlorides;

wherein the hydroprocessing catalyst is activated for simultaneous dehydrochlorination, hydrocracking and hydrodealkylation; and wherein one or more chloride compounds are contained in and/or added to the hydrocarbon stream in an amount of 10 ppm chloride, based on a total weight of the hydrocarbon stream, and the treated hydrocarbon stream comprises one or more chloride compounds in an amount of less than 10 ppm chloride, based on a total weight of the treated hydrocarbon stream.

2. The process of claim 1, wherein the step (a) of contacting the hydrocarbon stream with a hydroprocessing catalyst is performed at (i) a temperature of 260° C. and (ii) a hydrogen to hydrocarbon ratio of 800 NL/L.

3. The process of claim 1, wherein the hydroprocessing catalyst is activated in-situ.

4. The process of claim 1, wherein the hydroprocessing catalyst comprises tungsten and molybdenum on an alumina support, platinum and palladium on an alumina support, nickel sulphides, nickel sulphides on an alumina support, molybdenum sulphides, molybdenum sulphides on an alumina support, or combinations thereof.

5. The process of claim 1, wherein one or more sulphides are contained in and/or added to the hydrocarbon stream in an amount effective to provide for a sulphur content of the hydrocarbon stream of from about 0.05 wt. % to about 5 wt. %, based on the total weight of the hydrocarbon stream.

6. The process of claim 1, further comprising feeding the treated hydrocarbon stream to a steam cracker.

7. The process of claim 6, wherein the treated hydrocarbon stream is characterized by a boiling end point of 370° C.

8. The process of claim 1, wherein the step (b) of recovering a treated hydrocarbon stream from the hydrocarbon product comprises (i) separating a treated product from a sulphur and chlorine-containing gas in a separator; and (ii) flowing the treated product in the treated hydrocarbon stream from the separator.

9. The process of claim 1, wherein the step (b) of recovering a treated hydrocarbon stream from the hydrocarbon product comprises:

(i) separating an intermediate treated product from a sulphur and chlorine-containing gas in a separator;

(ii) distilling the intermediate treated product in a distillation column to produce a treated hydrocarbon stream characterized by a boiling end point of less than about 370° C. and a heavy treated hydrocarbon stream characterized by a boiling end point of equal to or greater than about 370° C.;

(iii) feeding at least a portion of the treated hydrocarbon stream to a steam cracker; and (iv) recycling at least a portion of the heavy treated hydrocarbon stream to the hydroprocessing reactor.

10. The process of claim 1, wherein the hydrocarbon stream further comprises $C_{6-8}$ aromatic hydrocarbons and the treated hydrocarbon stream further comprises $C_{6-8}$ aromatic hydrocarbons, and wherein an amount of $C_{6-8}$ aromatic hydrocarbons in the treated hydrocarbon stream is greater than an amount of $C_{6-8}$ aromatic hydrocarbons in the hydrocarbon stream.

11. The process of claim 1, wherein the hydrocarbon stream further comprises $C_{6-8}$ aromatic hydrocarbons and heavy hydrocarbon molecules, and the treated hydrocarbon stream further comprises $C_{6-8}$ aromatic hydrocarbons, and wherein an amount of $C_{6-8}$ aromatic hydrocarbons in the treated hydrocarbon stream is increased by equal to or greater than at least 1 wt. % when compared to an amount of $C_{6-8}$ aromatic hydrocarbons in the hydrocarbon stream.

12. The process of claim 1, wherein at least about 5 wt. % of the $C_9$ aromatic hydrocarbons in the hydrocarbon stream are hydrodealkylated in step (a).

13. The process of claim 1, wherein the hydroprocessing catalyst comprises tungsten and molybdenum on an alumina support.

14. The process of claim 1, wherein the hydroprocessing catalyst comprises platinum and palladium on an alumina support.

15. The process of claim 1, wherein the hydroprocessing catalyst comprises nickel sulphides.

16. A process for hydrodealkylating a hydrocarbon stream consisting of the steps of:

(a) contacting the hydrocarbon stream with a hydroprocessing catalyst in a hydroprocessing reactor in the presence of hydrogen to yield a hydrocarbon product, wherein the hydrocarbon stream contains $C_9$ aromatic hydrocarbons; and (b) recovering a treated hydrocarbon stream from the hydrocarbon product, wherein the treated hydrocarbon stream comprises $C_9$ aromatic hydrocarbons, wherein an amount of $C_9$ aromatic hydrocarbons in the treated hydrocarbon stream is less than an amount of $C_9$ aromatic hydrocarbons in the hydrocarbon stream due to hydrodealkylating of at least a portion of $C_9$ aromatic hydrocarbons from the hydrocarbon stream during the step (a) of contacting;

wherein the step (a) of contacting the hydrocarbon stream with a hydroprocessing catalyst is performed at (i) a temperature of from 100° C.; (ii) a pressure of 1 bar absolute; (iii) a weight hourly space velocity of 0.1 $hr^{-1}$; and (iv) a hydrogen to hydrocarbon ratio of 3,000 NL/L; and wherein the hydroprocessing catalyst is activated in-situ and/or ex-situ by contacting the hydroprocessing catalyst with a stream containing sulphides and chlorides and the hydroprocessing catalyst is activated for simultaneous dehydrochlorination, hydrocracking and hydrodealkylation.

* * * * *